US005397424A

United States Patent [19]

Sakano et al.

[11] Patent Number: 5,397,424

[45] Date of Patent: Mar. 14, 1995

[54] APPARATUS FOR CONTINUOUSLY SUPPLYING STRIP-LIKE MATERIAL

[75] Inventors: Makoto Sakano, Ooyamahigashi; Toshihide Kohata, Tokyo, both of Japan

[73] Assignee: Japan Tobacco Inc., Tokyo, Japan

[21] Appl. No.: 263,400

[22] Filed: Jun. 21, 1994

Related U.S. Application Data

[63] Continuation of Ser. No. 948,615, Sep. 22, 1992, abandoned, which is a continuation of Ser. No. 513,837, Apr. 24, 1990, abandoned.

[30] Foreign Application Priority Data

Apr. 26, 1989 [JP] Japan ..... 1-104624

[51] Int. Cl.[6] ..... B65H 19/00

[52] U.S. Cl. ..... 156/502; 156/157; 156/364; 242/562; 242/562.1

[58] Field of Search ..... 156/157, 304.3, 363, 156/364, 504, 505, 512, 544, 584; 242/551, 555, 555.3, 562, 562.1

[56] References Cited

U.S. PATENT DOCUMENTS

| | | | |
|---|---|---|---|
| 3,024,157 | 3/1962 | Beerli | 156/504 |
| 3,645,463 | 2/1972 | Helm | 242/58.1 |
| 3,918,655 | 11/1975 | Hillner et al. | 242/58.1 |
| 4,262,855 | 4/1981 | Haag | 242/58.1 |
| 4,278,489 | 7/1981 | Horsley | 242/58.4 X |
| 4,290,834 | 9/1981 | Buettel | 242/58.4 X |
| 4,543,152 | 9/1985 | Nozaka | 156/504 X |
| 4,555,281 | 11/1985 | Mattei et al. | 156/504 X |
| 4,848,691 | 7/1989 | Muto et al. | 156/504 X |
| 4,953,805 | 9/1990 | Rauh | 242/58.6 |
| 4,965,118 | 10/1990 | Kodera et al. | 156/233 X |
| 4,984,750 | 1/1991 | Shigeta et al. | 156/504 X |

FOREIGN PATENT DOCUMENTS

| | | |
|---|---|---|
| 0263920 | of 1988 | European Pat. Off. . |
| 0273287 | of 1988 | European Pat. Off. . |
| 2906598 | of 1980 | Germany . |
| 3605410 | of 1986 | Germany . |
| 3531731 | of 1987 | Germany . |

*Primary Examiner*—David A. Simmons
*Assistant Examiner*—James J. Engel
*Attorney, Agent, or Firm*—Nixon & Vanderhye

[57] ABSTRACT

An apparatus has first and second loading means, and first and second rolls each obtained by winding a strip-like material are loaded on the first and second loading means. A detection means detects an end indication tape adhered to a trailing end portion of the strip-like material of the roll. A cutting/unrolling means automatically unrolls the strip-like material from the roll, and cuts the leading and trailing end portions of the strip-like material to form the leading and trailing ends. The unrolled strip-like material is guided along a predetermined path by a guide means. A joining station is arranged midway along the guide path. One strip-like material is fed through the joining station by a feeding means, and the leading end portion of the other strip-like material is stopped and stands by at the joining station. When the trailing end of one strip-like material passes through the joining station, the leading end of the other standby strip-like material is joined to the trailing end of the one strip-like material by a joining means. A portion of the fed strip-like material is accumulated by a dancer roller means, and is fed during the joining operation, so that feeding of the strip-like materials is not interrupted.

5 Claims, 18 Drawing Sheets

APPARATUS FOR CONTINUOUSLY SUPPLYING STRIP-LIKE MATERIAL

This is a continuation of application Ser. No. 07/948,615, filed Sep. 22, 1992, now abandoned, which in turn is a continuation of Ser. No. 07/513,837, filed Apr. 24, 1990, now abandoned.

BACKGROUND OF THE INVENTION

1. Field of the Invention

The present invention relates to an apparatus which unrolls and feeds a strip-like material, e.g., strip-like wrapping paper for forming packages of cigarettes from a roll which is formed by winding the strip-like material in a roll shape, and when the strip-like material of this roll runs short, can feed a new strip-like material from another roll, i.e., can continuously feed the strip-like material.

2. Description of the Related Art

As a strip-like material continuous feeding apparatus, apparatuses disclosed in Published Unexamined Japanese Patent Application Nos. 61-226443 and 63-162434 are known. In either of the apparatuses disclosed in these patent applications, when a strip-like material, e.g., wrapping paper of cigarettes unrolled and fed from a first roll is about to end, new wrapping paper is unrolled and fed from a second roll to be continuous with the former wrapping paper.

In the apparatus disclosed in Published Unexamined Japanese Patent Application No. 61-226443, new wrapping paper is unrolled and fed from a second roll to be continuous with the trailing end of wrapping paper unrolled and fed from a first roll, and the trailing end of the wrapping paper from the first roll and the leading end of the new wrapping paper are aligned so that their patterns are continuous with each other. In this apparatus, the trailing end of the wrapping paper is not adhered to the leading end of the new wrapping paper. In this apparatus, the new wrapping paper unrolled from the second roll is continuously taken up by a takeup roller, and is replaced with the already fed wrapping paper while the new wrapping paper is being continuously taken up by the takeup roller. In this apparatus, therefore, a wrapping paper portion already taken up by the takeup roller is wasted.

In the apparatus disclosed in Published Unexamined Japanese Patent Application No. 63-162434, the leading end portion of new wrapping paper is bonded to the trailing end portion of the already fed wrapping paper by a joining tape. However, since the leading end portion of the new wrapping paper is bonded to overlap the trailing end portion of the already fed wrapping paper, the bonded and joined portion exerts various adverse influences in the following wrapping process. In order to bond the leading end portion of the new wrapping paper to overlap the trailing end portion of the already fed wrapping paper, a plurality of joining tapes are required, and a mechanism for independently supplying these tapes must be arranged. In this apparatus, the leading end of the new wrapping paper fed from the second roll must be moved to a convey path of the wrapping paper fed from the first roll. Therefore, this apparatus suffers from a complex structure.

SUMMARY OF THE INVENTION

The present invention has been made to eliminate the drawbacks of the conventional apparatuses, and has as its object to provide an apparatus which, when a strip-like material unrolled and fed from a first roll runs short, joins the leading end of a strip-like material of a second roll to the trailing end of the fed strip-like material to automatically feed a new strip-like material to be continuous with the already fed strip-like material, and which can smoothly and reliably replace the strip-like materials, and has a simple structure.

The apparatus of the present invention comprises first and second loading means. First and second rolls are respectively loaded in the first and second loading means.

The apparatus comprises a detection means. The detection means detects an end indication tape attached to the trailing end portions of strip-like materials of the first and second rolls.

The apparatus comprises a cutting/unrolling means. This means unrolls the leading end portion of the strip-like material from each roll, cuts the leading end portion at a predetermined position to form a new leading end, and unrolls and feeds this strip-like material. When the detection means detects the end indication tape of the strip-like material, this means cuts the trailing end portion of the strip-like material at a predetermined position to form a new trailing end.

The apparatus comprises a guide means for guiding the strip-like material fed from the cutting/unrolling means to a device for executing the next process, e.g., a cigarette wrapping device.

The apparatus comprises a feed means. The feed means conveys the strip-like material unrolled from the first roll through a joining station, or causes the leading end portion of the strip-like material unrolled from the second roll to wait in a still state.

The apparatus comprises a dancer roller means. The dancer roller means is arranged on the downstream side of the joining station in a feed direction of the strip-like material, and accumulates a portion of a fed first strip-like material.

The apparatus comprises a joining means. The joining means is arranged in the joining station, and joins the trailing end of a first strip-like material to the leading end of a second strip-like material by a joining tape.

In the apparatus of the present invention, when the first strip-like material unrolled and fed from the first roll runs short, the end indication tape is detected by the detection means. When the trailing end of the first strip-like material reaches the joining station, the trailing end of the first strip-like material and the leading end of the second strip-like material are joined by a joining tape by the joining means. In this manner, strip-like materials are alternately and continuously fed from the first and rolls. In this apparatus, while the trailing end of the first strip-like material and the leading end of the second strip-like material undergo joining, the first strip-like material accumulated in the dancer roller means is fed.

Therefore, feeding of these strip-like materials will not be interrupted. The leading and trailing end portions of the second and first strip-like materials are cut by the cutting/unrolling means at predetermined positions to precisely form new leading and trailing ends. Since these leading and trailing ends are joined, this joined portion will not adversely influence the following processes. Since the leading and trailing ends which are precisely cut in this manner are joined by the joining tape while mating with each other, only one joining tape need be used, and the structure of the apparatus can be simplified.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

An apparatus according to an embodiment of the present invention will be described below with reference to the accompanying drawings. This apparatus is a feeding apparatus for continuously feeding a strip-like material, e.g., strip-like paper for wrapping cigarettes to a wrapping device.

Figure 1:
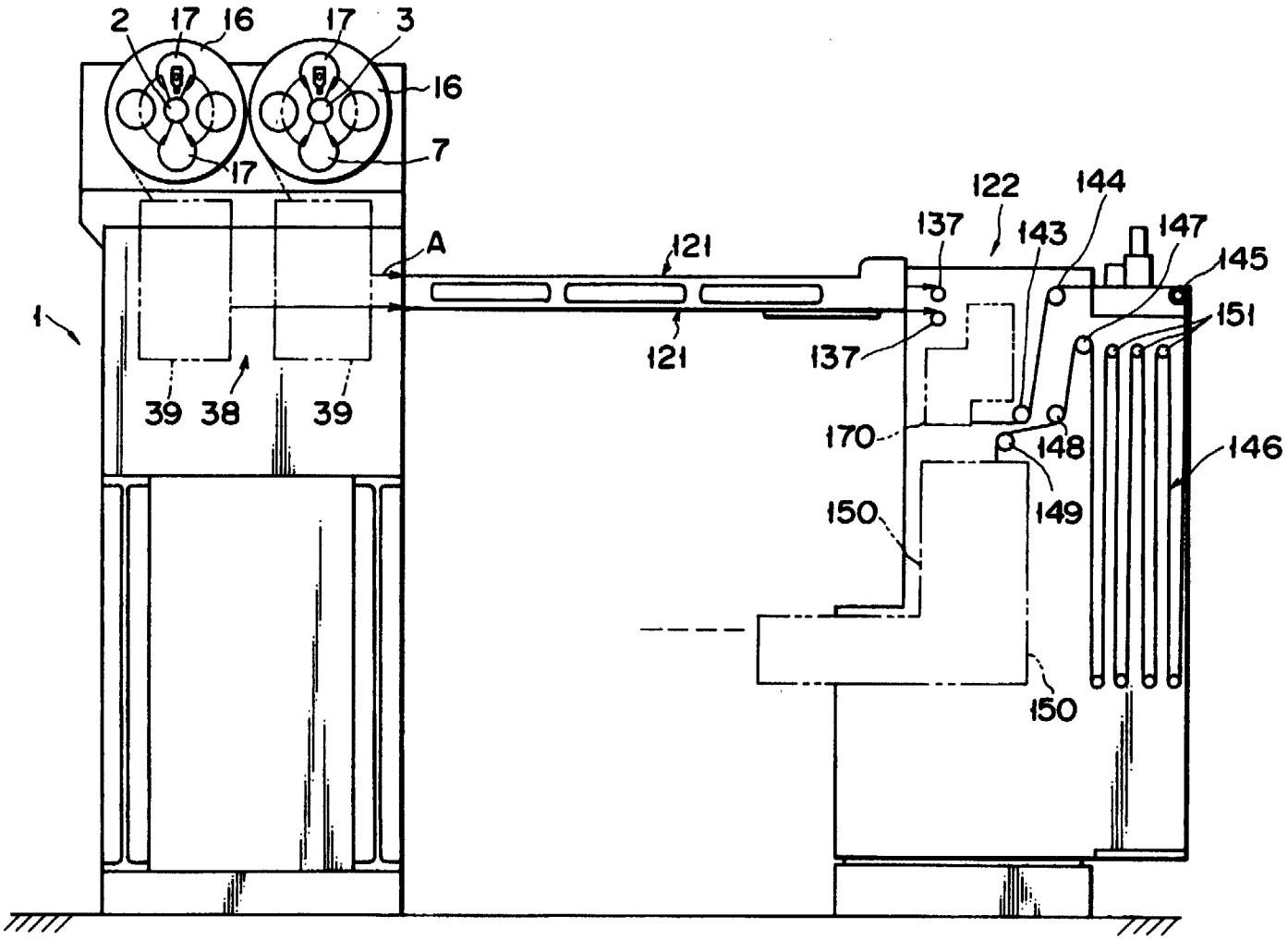
FIG. 1 is a schematic side view of the overall apparatus according to an embodiment of the present invention.

The continuous feeding apparatus feeds a wrapping material A for forming soft packages of cigarettes, and FIG. 1 schematically shows the overall continuous feeding apparatus.

The continuous feeding apparatus comprises a loading station 1 of a roll R which is formed by winding the wrapping material A on the left-hand side in FIG. 1. First and second loading shafts 2 and 3 which are horizontally separated from each other are mounted on the upper portion of the loading station 1. Rolls R are respectively loaded on these first and second loading shafts 2 and 3.

Figure 2:
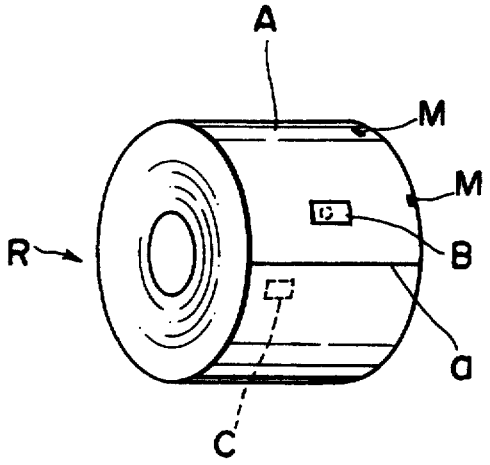
FIG. 2 is a perspective view of a roll used in the apparatus of the present invention.
Figure 3:
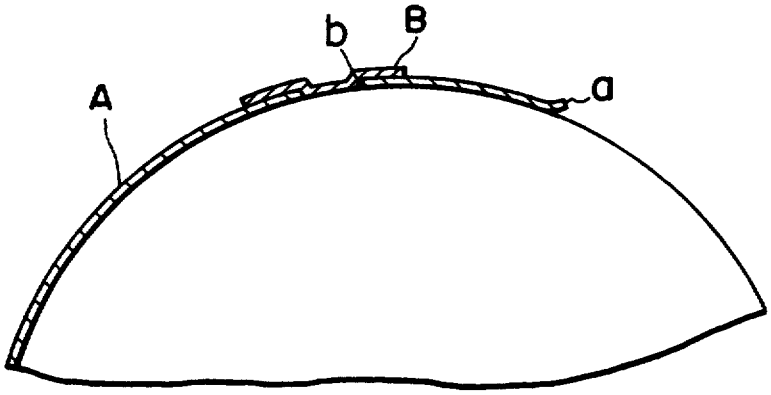
FIG. 3 is a partial sectional view of the roll.

The roll R is formed by winding the wrapping material A, as shown in FIGS. 2 and 3. The leading end portion of the wrapping material A is fixed at a position at a predetermined distance from the leading end a by an adhesive tape B. More specifically, a circular hole b is formed at the center of the leading end portion of the wrapping material A to be separated from the leading end a by a predetermined distance, and the adhesive tape B is attached to close this hole. Thus, the leading end portion of the wrapping material A is fixed to the outer peripheral surface of the roll R. The adhesive tape B comprises an aluminum tape. An end indication tape (not shown) for indicating the trailing end of the wrapping material A is adhered to the wrapping material A of the roll R at a position separated from the trailing end by a predetermined distance. The end indication tape also comprises an aluminum tape as in the adhesive tape B, and is adhered to the central portion of the wrapping material A. Furthermore, register marks M are printed on one side edge of the wrapping material A at equal intervals in the longitudinal direction of the wrapping material A. The register marks M are formed at an interval corresponding to a length of the wrapping material A required for one soft package.

Loading mechanisms for loading the rolls R to the first and second loading shafts 2 and 3, and the driving mechanisms for the first and second loading shafts 2 and 3 are respectively the same, and the loading and driving mechanisms for only the first loading shaft 2 will be described below with reference to FIG. 4.

The first loading shaft 2 is rotatably supported on a base frame 4 of the loading station 1 through a pair of bearings 5. One end portion of the first loading shaft 2, which extends from the base frame 4, constitutes an actual loading portion of the roll R. On the other hand, a gear 6 is mounted on the other end portion of the first loading shaft 2, which extends inside the base frame 4. The gear 6 is meshed with a gear 7. The gear 7 is mounted on a rotating shaft 9 rotatably supported on the base frame 4 through a pair of bearings 8. The rotating shaft 9 is parallel to the first loading shaft 2. Furthermore, a gear 10 is rotatably mounted on the rotating shaft 9 through a pair of bearings 11 at a position adjacent to the gear 7. The gear 10 is meshed with a driving gear 12. The driving gear 12 is mounted on the output shaft of a reversible electric motor 13. The electric motor 13 is supported on the base frame 4.

A clutch 14 is mounted on the rotating shaft 9. The clutch 14 has a function of engaging/disengaging a rotational driving force to be transmitted from the driving gear 12 to the rotating shaft 9 through the gear 10. Therefore, when the clutch 14 is engaged, the first loading shaft 2 can be rotated by the electric motor 13 through the driving gear 12, the gear 10, the clutch 14, the rotating shaft 9, and the gears 7 and 6.

A powder brake 15 supported on the base frame 4 is mounted on the rotating shaft 9. The powder brake 15 has a function of giving a predetermined braking force to the rotating shaft 9 to prevent an excessive tension from acting on the wrapping material A unrolled from the roll R as the diameter of the roll R is decreased.

A back plate 16 for the roll R is attached to the loading portion of the first loading shaft 2. A pair of through holes 17 are formed in the back plate 16, as shown in FIG. 1. Four locking lugs 18, for example, are retractably mounted on the peripheral surface of the loading portion of the first loading shaft 2 at equal angular intervals in the circumferential direction. These locking lugs 18 are held while projecting from the peripheral surface of the loading portion by compressed air. More specifically, an injection port 19 with a valve for introducing compressed air into the first loading shaft 2 is formed in the other end face of the first loading shaft 2, and an injection nozzle 20 is arranged on the other end side of the first loading shaft 2 to face the injection port 19. The injection nozzle 20 is connected to a compressed air source (not shown), and can approach/separate from the injection port 19 of the first loading shaft 2 by an air cylinder 21.

Therefore, while the roll R is attached to the loading portion of the first loading shaft 2, the air cylinder 21 is expanded to connect the injection nozzle 20 to the injection port 19, and the valve is opened, thereby supplying compressed air to the interior of the first loading shaft 2. Thus, the locking lugs 18 of the first loading shaft 2 project, and are urged against the inner peripheral surface of the roll R. As a result, the roll R can be attached to and held by the loading portion of the first loading shaft 2.

In order to detach the roll R, in practice, a core (not shown) of the roll R from the first loading shaft 2 after the wrapping material A of the roll R is used up, a release pusher 22 which can pass through each through hole 17 of the back plate 16 is used. More specifically, the release pusher 22 is located between the back plate 16 and the base frame 4 at a rest position illustrated in FIG. 4, and is mounted on the distal end of a piston rod 24 of an air cylinder 23. Note that the air cylinder 23 is supported by the base frame 4.

Figure 4:
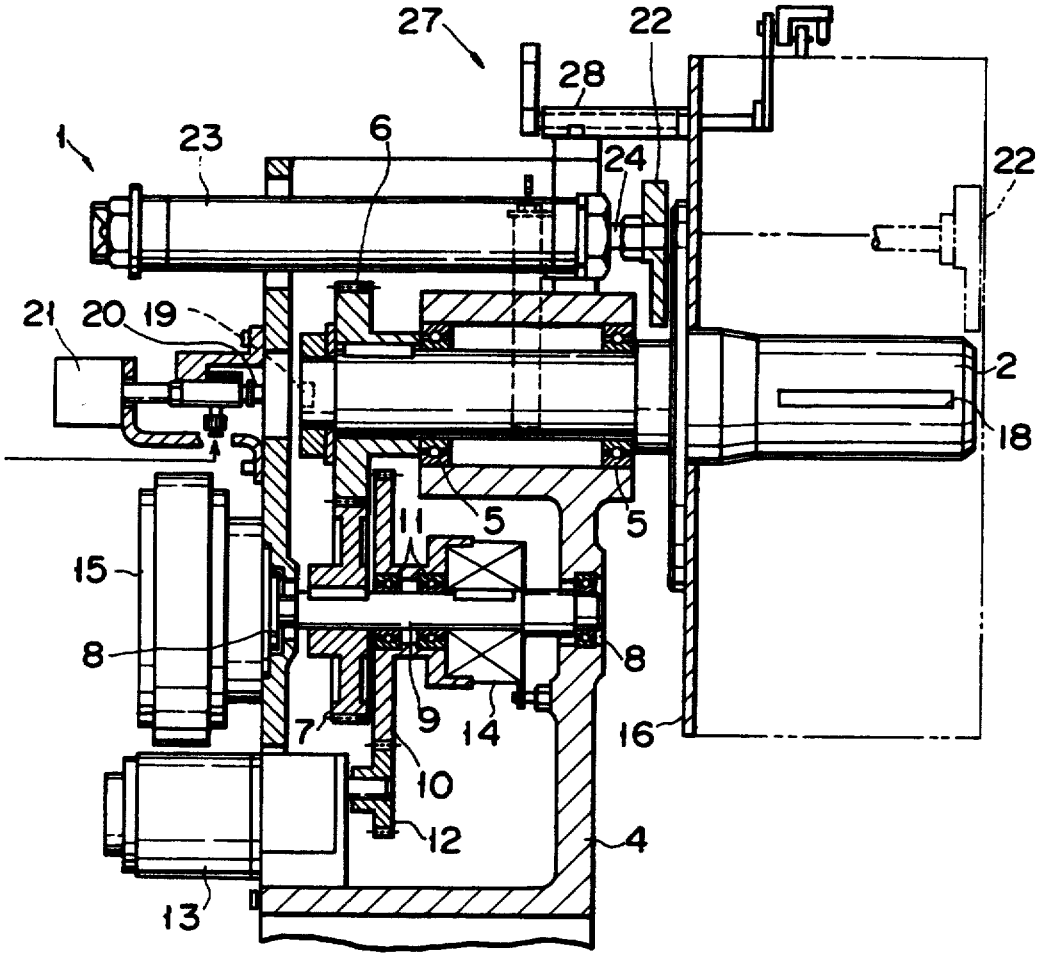
FIG. 4 is a sectional view of a roll driving mechanism.

Therefore, after the pressing forces of the locking lugs 18 of the first loading shaft 2 are released, the air cylinder 23 is expanded to push out the release pusher 22, as indicated by an imaginary line in FIG. 4, thereby detaching the core of the roll R from the first loading shaft 2.

Figure 5:
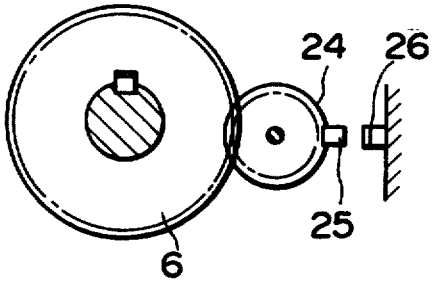
FIG. 5 is a view showing an arrangement of gears in the driving mechanism.

As can be apparent from the above description, when the roll R is detached from the first loading shaft 2, the corresponding through hole of the back plate 16 must be aligned with the release pusher 22. This alignment can be attained by detecting a rotational angle of the first loading shaft 2. More specifically, in order to detect the rotational angle of the first loading shaft 2, as shown in FIG. 5, a rotational angle detection gear 6*a* is meshed with the gear 6 of the first loading shaft 2. The gear 6*a* is rotated once per half a rotation of the gear 6. A timing plate 25 is mounted on the gear 6*a*, and a sensor 26 for detecting passage of the timing plate 25 is fixed near the gear 6*a*. Therefore, the mounting position of the timing plate 25 with respect to the gear 6*a* can be set at a position corresponding to one through hole 17 of the back plate 16. Thus, when rotation of the first loading shaft 2 is stopped upon reception of a detection signal from the sensor 26, the through hole 17 of the back plate 16 can be aligned with the release pusher 22.

The sensor 26 can comprise a proximity sensor or a photosensor. The detection signal from the sensor 26 can be used not only to detect the rotational angle of the first loading shaft 2 but also to detect the current diameter of the roll R which is decreased as the wrapping material A is unrolled by counting the number of detection signals.

Figure 6:
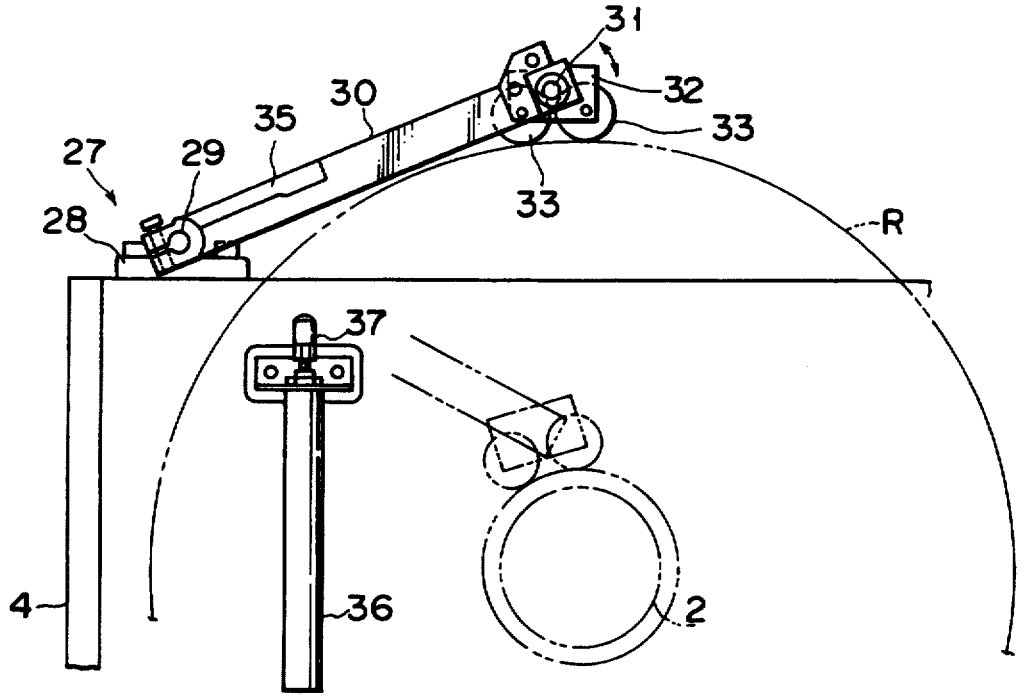
FIG. 6 is a side view of a detection means.
Figure 7:
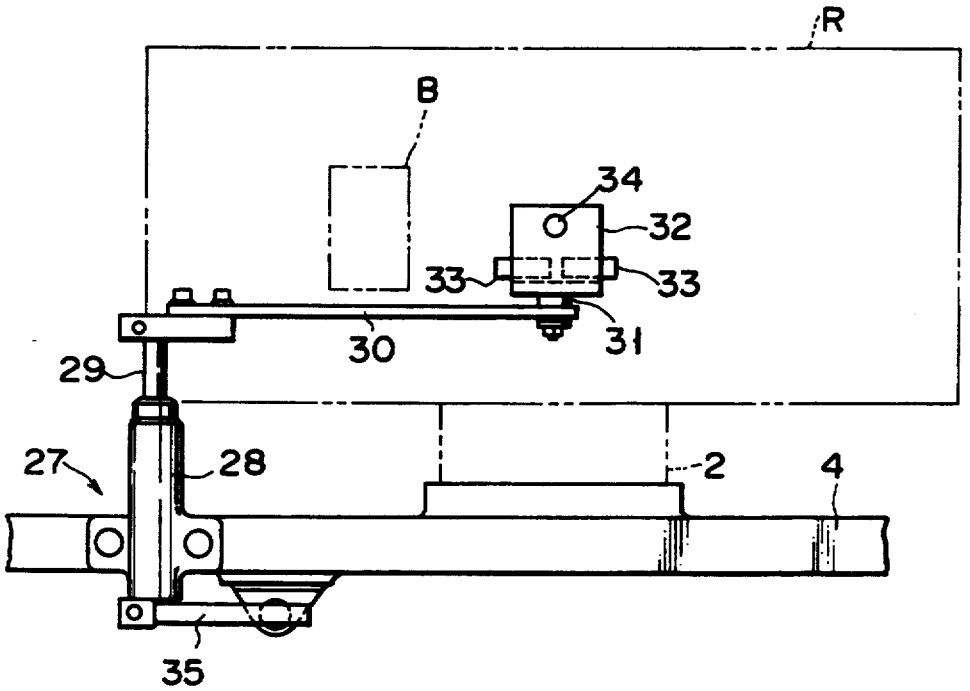
FIG. 7 is a plan view of the detection means.

Referring to FIGS. 6 and 7 in addition to FIG. 4, a detection device 27 for detecting the adhesive tape B and the end indication tape of the roll R while the roll R is loaded on the first loading shaft 2 is disposed in the loading station 1.

The detection device 27 comprises a pivot shaft 29 mounted on the upper portion of the loading station 1, i.e., the upper end of the base frame 4 through a bearing base 28. As can be seen from FIG. 6, the pivot shaft 29 is located outside the roll R, and extends to be parallel to the first loading shaft 2.

One end of the pivot shaft 29 projecting toward the roll R extends to overlap the peripheral surface of the roll R when viewed in the vertical direction. A pivot arm 30 is mounted on this end. A roller carrier 32 is pivotally arranged on the distal end portion of the pivot arm 30 through a support pin 31. A pair of rollers 33 which can be brought into rolling contact with the peripheral surface of the roll R are rotatably mounted on the roller carrier 32. These rollers 33 are mounted to be separated from the axis of the support pin 31 by the same distance in the circumferential direction of the roll R. A photosensor 34 is arranged on the roller carrier 32 to be located above the central portion of the peripheral surface of the roller R and along the axis of the support pin 31. The photosensor 34 outputs a detection signal when the adhesive tape B or the end indication tape of the roll R passes below the photosensor 34.

The other end of the pivot shaft 29 projects in the base frame 4. A release arm 35 for the pivot arm 30 is mounted on this end. As can be apparent from FIG. 6, the release arm 35 extends to be parallel to the pivot arm 30 in the same direction. An air cylinder 36 stands upright on the base frame 4 to be located below the release arm 35. A pusher 37 which can be engaged with the release arm 35 is mounted on the distal end of the piston rod of the air cylinder 36.

According to the detection device 27 described above, when the roll R is loaded on the first loading shaft 2, the air cylinder 36 is expanded, and the release arm (lever) 35, e.g., the pivot arm (lever) 30 is pivoted upward by the pusher 37 to a position where it does not disturb loading of the roll R. In this state, the roll R is loaded on the first loading shaft 2, and thereafter, the air cylinder 36 is contracted, as shown in FIG. 6. Thus, the pivot arm 30 is pivoted downward by its weight, and, hence, the pair of rollers 33 of the roller carrier 32 are brought into rolling contact with the peripheral surface of the roll R.

When the core of the roll R is removed from the first loading shaft 2, the pivot lever 30 is pivoted upward in the same manner as described above. Although not shown, the same detection device as the detection device 27 described above is equipped at the side of the roll R loaded on the second loading shaft 3.

Figure 8:
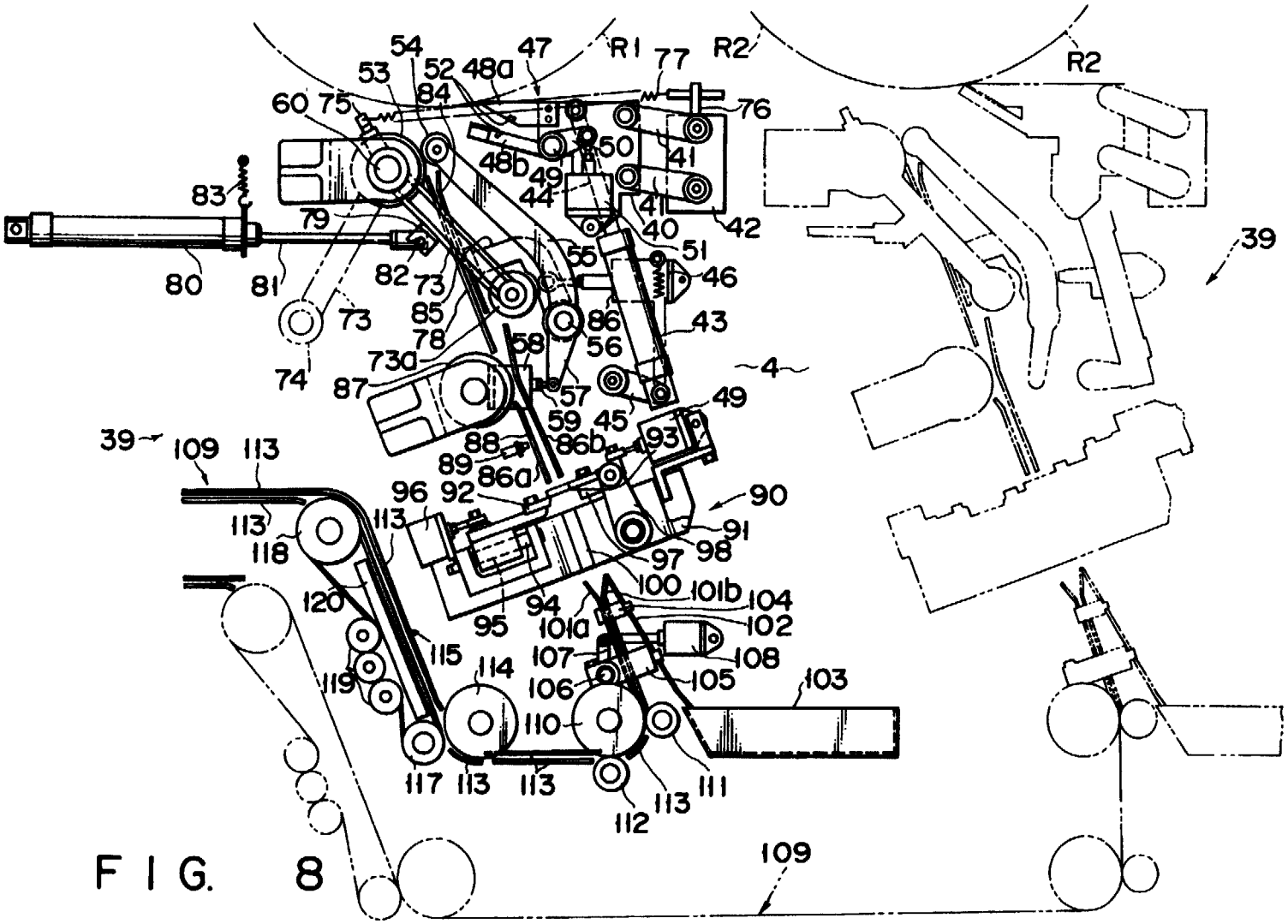
FIG. 8 is a side view of a cutting/unrolling means.

A cutting/unrolling device 38 is disposed below first and second rolls R1 and R2 respectively loaded on the first and second loading shafts 2 and 3, as schematically shown by a block in FIG. 1. The cutting/unrolling device 38 comprises a pair of cutting/unrolling units 39 paired with the rolls R of the loading shafts 2 and 3. Each cutting/unrolling unit 39 has the same structure. Thus, FIG. 8 shows in detail only the cutting/unrolling unit 39 paired with the first roll R1 of the first loading shaft 2.

In the cutting/unrolling unit 39, a chuck head 40 is disposed below the first roll R1. The chuck head 40 is mounted on a support block 42 through a pair of parallel links 41. The chuck head 40 is supported by a lift cylinder 43 comprising an air cylinder. More specifically, the chuck head 40 is axially supported on the distal end of a piston rod 44 of the lift cylinder 43, and is supported on the base frame 4 through a link 45. A compression coil spring 46 extends between the link 45 and the base frame 4. The lift cylinder 43, i.e., the chuck head 40 is biased upward by a predetermined force by the compression coil spring 46.

A chuck 47 is mounted on the chuck head 40. The chuck 47 comprises a stationary chuck pawl **48*a* extending in the tangential direction of the first roll R1, and a movable chuck pawl 48*b* located below the stationary chuck pawl 48*a*. The stationary chuck pawl 48*a* has an upper surface contiguous from the upper surface of the chuck head 40, as shown in FIG. 8, and its distal end portion is tapered toward the distal end. On the other hand, the proximal end portion of the movable chuck pawl 48*b* is pivotally mounted on the chuck head 40 through a chuck shaft 49. A link 50 extending in a direction opposite to the extending direction of the movable chuck pawl 48*b* is mounted on the chuck shaft 49. The link 50 is coupled to a piston rod of an opening/closing cylinder 51 comprising an air cylinder. The opening/-closing cylinder 51 is mounted on the chuck head 40. Therefore, the movable chuck pawl 48*b* is pivoted by expanding/contracting the opening/closing cylinder 51, thereby opening/closing the chuck 47. Furthermore, photosensors 52 are mounted on the stationary and movable chuck pawls 48*a* and 48*b*. Each photosensor 52** comprises a light-emitting element and a light-receiving element which are arranged to oppose each other.

Therefore, according to the above-mentioned arrangement, when the lift cylinder 43 is contracted, the chuck head 40, i.e., the chuck 47 can be moved to approach/separate from the first roll R1. In this case, since the chuck head 40 is moved upward/downward through the pair of parallel links 41, the chuck 47, i.e., the stationary chuck pawl **48*a* is parallelly moved in the vertical direction. As a result, when the chuck 47 is brought into contact with the peripheral surface of the first roll R1, the stationary chuck pawl 48*a* will not bite into the peripheral surface of the first roll R1 and damage the wrapping material A. The lift cylinder 43 is supported on the base frame 4 through the link 45, and is biased upward by the compression coil spring 46, as described above. Therefore, if the diameter of the first roll R1 before the wrapping material A is unrolled, i.e., of a new first roll R1 slightly varies, the stationary chuck pawl 48*a*** can be urged against the peripheral surface of the first roll R1 at a constant pressure.

A base feed roller 53 is rotatably arranged in front of the chuck 47 to be located near the peripheral surface of the first roll R1. A pair of pinch feed rollers 54 (FIG. 9) are arranged near the chuck 47. The pinch feed rollers 54 are brought into rolling contact with the base feed roller 53 and can approach/separate from it. Each pinch feed roller 54 is mounted on the upper end of a corresponding vertical pivot lever 55. The lower end of each pivot lever 55 is mounted on a pivot shaft 56. Furthermore, the pivot shaft 56 is rotatably supported by the base frame 4. A link 57 extending downward is mounted on the pivot shaft 56. The lower end of the link 57 is coupled to a piston rod 59 of an air cylinder 58. Therefore, when the air cylinder 58 is expanded/contracted to pivot the pivot levers 55, the pinch feed rollers 54 can approach/separate from the base feed roller 53.

Figure 9:
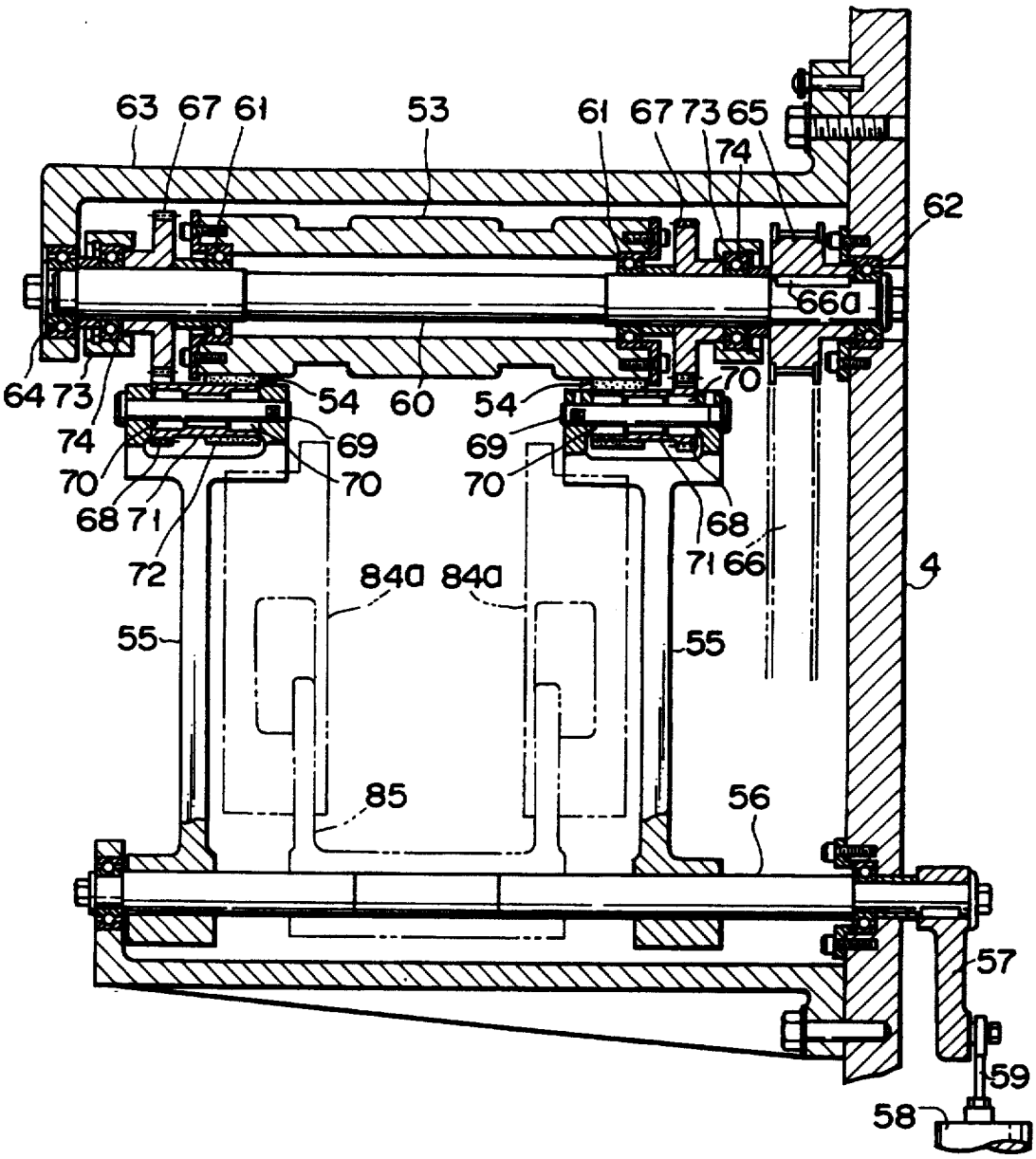
FIG. 9 is a sectional view of base and feed pitch rollers.

FIG. 9 illustrates in detail the positional relationship between the base feed roller 53 and the pinch feed rollers 54. More specifically, the base feed roller 53 is rotatably mounted on a roller shaft 60 through a pair of bearings 61. One end of the roller shaft 60 is rotatably mounted on the base frame 4 through a bearing 62, and the other end thereof is rotatably supported on a support arm 63 through a bearing 64.

A toothed pulley 65 is mounted on the one end portion of the roller shaft 60 through a key **66*a*. An endless toothed belt 66 is looped on the toothed pulley 65. The toothed belt 66 is looped on a toothed driving pulley (not shown). Thus, when the driving pulley is rotated, the roller shaft 60 is rotated in one direction through the toothed belt 66 and the toothed pulley 65**.

A pair of gears 67 are mounted on the roller shaft 60 on the two sides of the base feed roller 53. Contrary to this, each pinch feed roller 54 is equipped with a gear 68 which can be meshed with a corresponding gear 67 when the pinch feed rollers 54 are in rolling contact with the base feed roller 53. The pinch feed rollers 54 will be described below. Each pinch feed roller 54 comprises a rotary sleeve 71 rotatably mounted on the upper end of the corresponding pivot lever 55 through a pair of roller bearings 70, and a roller ring 72 mounted on the rotary sleeve 71 and formed of an elastic material. The above-mentioned gear 68 is attached to the rotary sleeve 71.

Therefore, according to the above-mentioned arrangement, when the pinch feed rollers 54 are in rolling contact with the base feed roller 53 and the roller shaft 60 is rotated, the rotating force is transmitted to the pinch feed rollers 54 through the gears 67 and 68, and the pinch feed rollers 54 are rotated thereby. Note that the base feed roller 53 is rotated upon rotation of the pinch feed rollers 54. When the air cylinder 58 is expanded, the pivot levers 55 are pivoted through the links 57 to separate the corresponding pinch feed rollers 54 from the base feed roller 53. Thus, the gear 67 of the roller 60 and the gears 68 of the pinch feed rollers 54 are disengaged from each other. As a result, the base feed roller 53 and the pinch feed rollers 54 can be freely rotated.

A pair of tension levers 73 are mounted on the two end portions of the roller shaft 60 of the above-mentioned base feed roller 53 via bearings **73*a*. FIG. 9 illustrates only mounting portions of the tension levers 73 to the roller shaft 60. As can be seen from FIG. 8, the tension levers 73 extend downward, and a tension roller 74 is rotatably arranged between the lower ends of the tension levers 73. Coupling members 75 for coupling these tension levers 73 project from the upper end portions of the tension levers 73. A tension spring 77 comprising a tensile coil spring extends between the coupling members 75 and the base frame 4, e.g., a projection 76 of the support block 42. The tension spring 77 biases the tension levers 73 clockwise in FIG. 8 by a predetermined force. Furthermore, a guide plate 78 for the wrapping material A is mounted to extend between the two tension levers 73. The guide plate 78 is located to extend obliquely downward from the base feed roller 53 while the tension levers 73 are in a state indicated by a solid line, although it is only schematically illustrated in FIG. 8. An engaging bracket 79 is mounted on one tension lever 73 to project in a direction opposite to the pivot lever 55. The engaging bracket 79 can be engaged with an engaging pin 82 mounted on the distal end of a piston rod 81 of an air cylinder 80. More specifically, when the air cylinder 80 is expanded, the engaging pin 82 is engaged with the engaging bracket 79 to be able to pivot the tension levers 73 to a solid line position of FIG. 8. The base portion of the outer cylinder of the air cylinder 80 is pivotally supported on the base frame 4, and the distal end of the outer cylinder is elastically suspended from the base frame 4 through a suspension spring 83. When the air cylinder 80 is contracted, since the engaging pin 82 and the engaging bracket 79 are disengaged from each other, the tension levers 73 and the tension roller 74 can be returned to the position indicated by an imaginary line in FIG. 8 upon reception of the biasing force of the tension spring 77**.

A guide plate 84 is arranged near the guide plate 78 of the tension levers 73 to be located at a position opposite to the air cylinder 80. The guide plate 84 extends parallel to the guide plate 78 in a state illustrated in FIG. 8. These guide plates 78 and 84 define a portion of an unrolling path of the wrapping material A therebetween in cooperation with each other. The guide plate 84 comprises a pair of plate pieces 84a, as illustrated by imaginary lines in FIG. 9. These plate pieces **84*a* are located to be separated at a predetermined interval in the axial direction of the base feed roller 53. The guide plate 84 is rotatably mounted on the pivot shaft 56 through a pivot lever 85. The pivot lever 85 is coupled to a piston rod of an air cylinder 86. Therefore, upon expansion/contraction of the air cylinder 86, the guide plate 84 can be pivoted through the pivot lever 85 in a direction to approach/separate from the guide plate 78**.

A pair of guide plates **86*a* and 86*b* are fixed below the guide plates 78 and 84 to be continuous with these guide plates 78 and 84 and to define a portion of the unrolling path of the wrapping material A. A guide roller 87 for the wrapping material A is rotatably arranged between the guide plates 78 and 86*a*, and an opening 88 is formed in the guide plate 86*a*. A sensor 89 is arranged near the opening 88 to oppose it. The sensor 89 outputs a detection signal every time it detects a register mark M of the wrapping material A when the wrapping material A passes a gap between the guide plates 86*a* and 86*b***.

A cutter unit 90 is disposed below the guide plates **86*a* and 86*b*. The cutter unit 90 comprises a cutter block 91 which is fixed to and supported on the base frame 4. A pair of movable cutting blades 92 and 93 which are driven in a direction perpendicular to the unrolling path of the wrapping material A are mounted on the cutter block 91. One movable cutting blade 92 is fixed to a carrier 95. The carrier 95 is slidably mounted on a guide rod 94 of the cutter block 91. Reciprocal movement of the carrier 95 is attained by an air cylinder 96. The other movable cutting blade 93 is also mounted on a carrier 97. The carrier 97 is movably arranged on the cutter block 91 through a link 98, and its movement is attained by an air cylinder 99**.

A path 100 for the wrapping material A which is continuous with the unrolling path defined between the guide plates **86*a* and 86*b* is formed in the cutter block 91. A pair of guide plates 101*a* and 101*b* for defining a portion of the unrolling path of the wrapping material A in the same manner as the guide plates 86*a* and 86*b* are arranged below the cutter block 91 to be continuous with the path 100. The upper end portions of these guide plates 101*a* and 101*b* are opened to reliably guide the wrapping material A, as shown in FIG. 8. Furthermore, a plate-like exhaust guide 102 is arranged on the pair of guide plates 101*a* and 101*b*, and a dust box 103 is arranged below the exhaust guide 102**.

The guide plates **101*a* and 101*b*, and the exhaust guide 102 are coupled to each other through coupling members 104 and 105. Of these coupling members 104 and 105, the lower coupling member 105 is pivotally supported by a support shaft 106. An arm 107 projects from the coupling member 105, and is coupled to a piston rod of an air cylinder 108. Therefore, when the air cylinder 108 is expanded or contracted, the guide plates 101*a* and 101*b*, and the exhaust guide 102 can be pivoted about the support shaft 106. As a result, whether the upper ends of the guide plates 101*a* and 101*b* are connected to the path 100 of the cutter block 91 or the exhaust guide 102 is connected to the path 100** can be selected.

The operation of the cutting/unrolling unit 39 described above will be described below with reference to FIGS. 10 to 16 as well as the drawings referred to in the above description.

Figure 10:
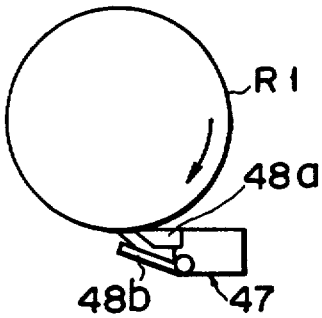
FIGS. 10 to 16 are schematic sectional views showing operations of a conveying/unrolling device in turn.
Figure 11:
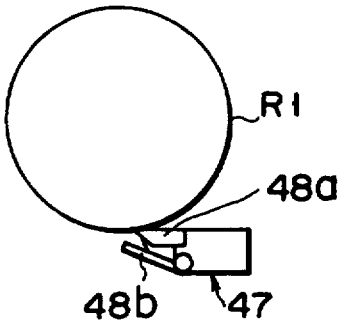
Figure 12:
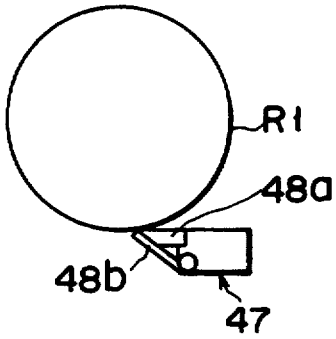
Figure 13:
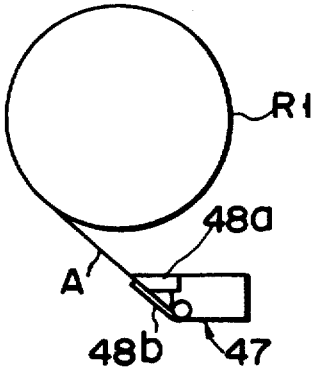

When the first roll R1 is loaded on the first loading shaft 2, the chuck 47 is moved upward in an open state, and as shown in FIG. 10, the stationary chuck pawl **48*a* of the chuck 47 is brought into contact With the peripheral surface of the first roll R1. In this state, the first roll R1 is rotated in a direction of an arrow in FIG. 10. When the adhesive tape B is detected by the photosensor 34 of the detection device 27 during rotation of the first roll R1, the rotation of the first roll R1 is stopped, and thereafter, the first roll R1 is rotated in a direction opposite to the direction of the arrow. When the first roll R1 is rotated in this direction and the leading end a of the wrapping material A of the first roll R1 reaches the chuck 47, the leading end a of the wrapping material A is picked up by the stationary chuck pawl 48*a*, as shown in FIG. 11. Thus, the leading end portion of the wrapping material A is guided into the chuck 47. In this manner, when the leading end portion of the wrapping material A guided into the chuck 47 passes by the photosensors 52, detection signals are output from the photosensors 52, and at that time, the chuck 47 is closed, as shown in FIG. 12. Thus, the leading end portion of the wrapping material A is clamped by the chuck 47. Thereafter, the chuck 47 is moved downward while clamping the wrapping material A, as shown in FIG. 13**. As a result, the adhesive tape B of the first roll R1 is peeled, and the leading end portion of the wrapping material A is set in a free state, so that the wrapping material A can be unrolled from the first roll R1.

Figure 14:
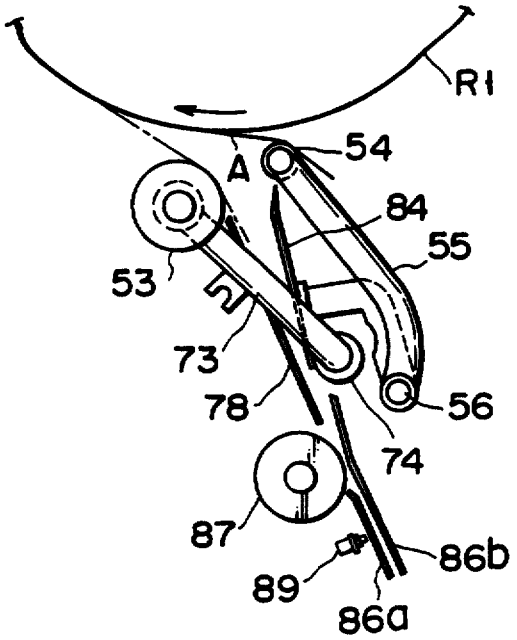

As described above, when the wrapping material A of the first roll R1 can be prepared to be unrolled, as shown in FIG. 14, the pinch feed rollers 54 are separated from the base feed roller 53, and the tension levers 73 and the guide plates 78 and 84 are located at illustrated positions. More specifically, the unrolling path of the wrapping material A defined between the guide plates 78 and 84 is opened so that the upper end portions of the guide plates are spread.

Figure 15:
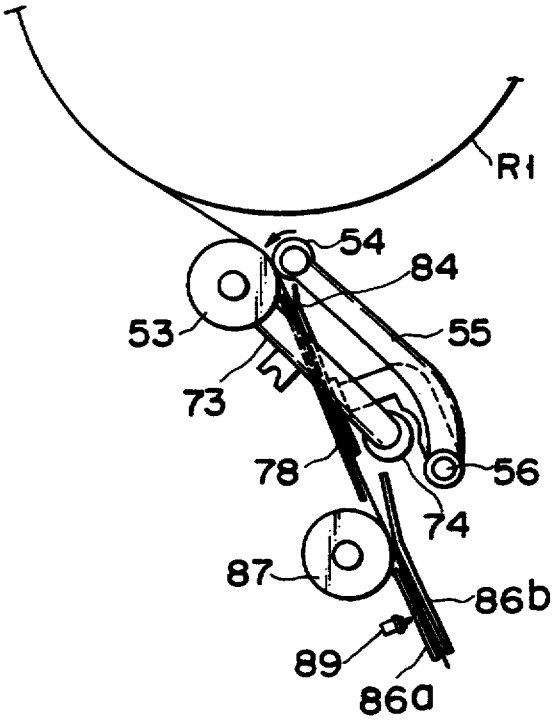

In this state, when the first roll R1 is rotated in a direction of an arrow in FIG. 14 at a predetermined rotational angle, the leading end portion of the wrapping material A clears the pinch feed rollers 54, and is then guided between the guide plates 78 and 84. Thereafter, the guide plate 84 is pivoted toward the guide plate 78 and is located to extend parallel to the guide plate 78. At the same time, the pinch feed rollers 54 are brought into rolling contact with the base feed roller 53, as shown in FIG. 15 to clamp the leading end portion of the wrapping material A, and receive the driving force from the base feed roller 53 to be rotated in a direction of an arrow in FIG. 15. Thus, the wrapping material A is unrolled from the first roll R1 to a gap between the guide plates 86a and 86b while passing between the guide plates 78 and 84 beyond the guide roller 87.

when the leading end portion of the wrapping material A passes by a gap between the guide plates 78 and 84, since the pair of plate pieces 84a constituting the guide plate 84 are separated from each other, the adhesive tape B remaining at the center of the leading end portion of the wrapping material A will not adhere to the guide plate 84 to prevent an unrolling operation of the wrapping material A.

Figure 16:
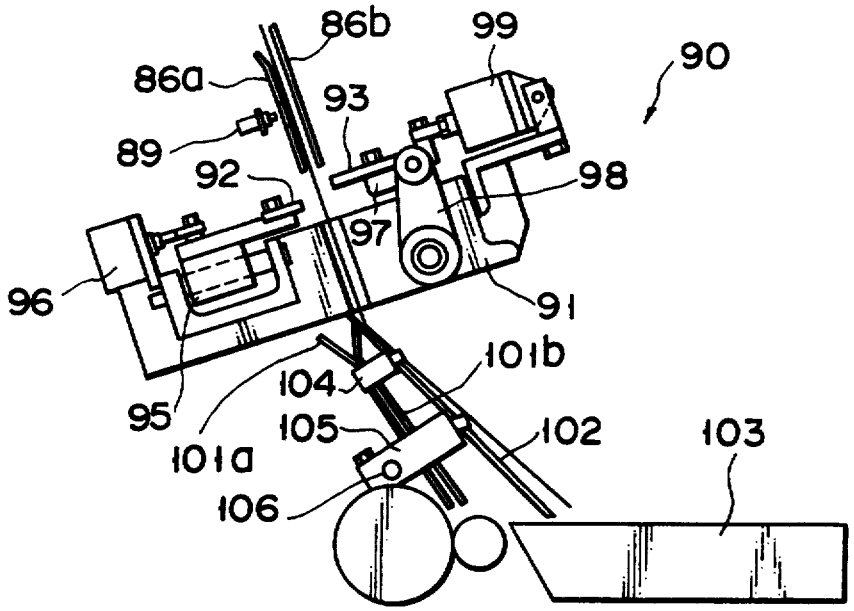

When the wrapping material A is unrolled, as described above, the movable cutting blades 92 and 93 of the cutter unit 90 are opened, as shown in FIG. 16, before the leading end of the wrapping material A reaches the cutter unit 90, and the guide plates 101a and 101b, and the exhaust guide 102 are inclined to be continuous with the path 100 of the cutter block 91.

When the wrapping material A begins to be unrolled in this state, the leading end portion of the wrapping material A passes through the path 100 of the cutter block 91 from a gap between the pair of guide plates 86a and 86b, and thereafter, can be guided by the exhaust guide 102.

When the wrapping material A is unrolled from the first roll R1 beyond the pair of movable cutting blades 92 and 93 by a predetermined length, the unrolling operation of the wrapping material A is interrupted. More specifically, in this embodiment, when the sensor 89 arranged on the side of the guide plate 86a detects passage of two register marks M formed on the wrapping material A, the unrolling operation of the wrapping material A by the pinch feed rollers 54 is stopped. The unrolling operation of the wrapping material A by the pinch feed rollers 54 is stopped by stopping a driving motor (not shown) for rotating the pinch feed rollers 54.

When the unrolling operation of the wrapping material A is stopped, the pair of movable cutting blades 92 and 93 of the cutter unit 90 are closed, and the wrapping material A is cut from a predetermined position, thereby forming a new leading end of the wrapping material A remaining on the side of the first roll R1. On the other hand, the adhesive tape B is kept adhered to the wrapping material piece cut in this manner, and is guided by the exhaust guide 102 to be recovered into the dust box 103.

Thereafter, the pair of guide plates 101a and 101b and the exhaust guide 102 are returned to pivot positions shown in FIG. 8.

After the leading end of the wrapping material A is formed by cutting in this manner, the wrapping material A of the first roll R1 passes through a gap between the pair of guide plates 101a and 101b to be further unrolled and conveyed. On the downstream side of the above-mentioned cutting/unrolling unit 39, the wrapping material A is guided along a convey path 109.

The convey path 109 will be described below. The convey path 109 guides the wrapping material A between the cutting/unrolling unit 39 and a joining device (to be described later). The convey path 109 comprises a base feed roller 110 arranged near the lower ends of the pair of guide plates 101a and 101b, and a pair of pinch feed rollers 111 and 112 which can be in rolling contact with and can be separated from the base feed roller 110. The base feed roller 110 and the pinch feed rollers 111 and 112 are schematically illustrated in FIG. 8, but have similar structures and drive systems to those of the base feed roller 53 and the pinch feed rollers 54 described above. Thus, a detailed description of these rollers will be omitted. The wrapping material A unrolled from the first roll R1 is then fed by the base feed roller 110 and the pinch feed rollers 111 and 112, and is guided along a convey path defined by a plurality of guide plates 113 and a guide roller 114, as shown in FIG. 8. The convey path is provided with a raising portion 115. A portion of the convey path 109 in the raising portion 115 is constituted by a porous suction belt 116. The suction belt 116 is an endless belt, and is looped between a pair of pulleys 117 and 118. Of these pulleys 117 and 118, the pulley 118 serves as a driving pulley, and the pulley 117 serves as a driven pulley. A suction unit 120 connected to a negative pressure source (not shown) is arranged along the suction belt 116 between the pulleys 117 and 118. Therefore, according to this arrangement, when the conveyed wrapping material A reaches the raising portion 115, the wrapping material A is drawn by suction by the suction belt 116, and can be reliably guided upward.

A convey path defined between the guide plates 113 located on the downstream side of the raising portion 115 is connected to a convey restriction guide path 121.

Figure 17:
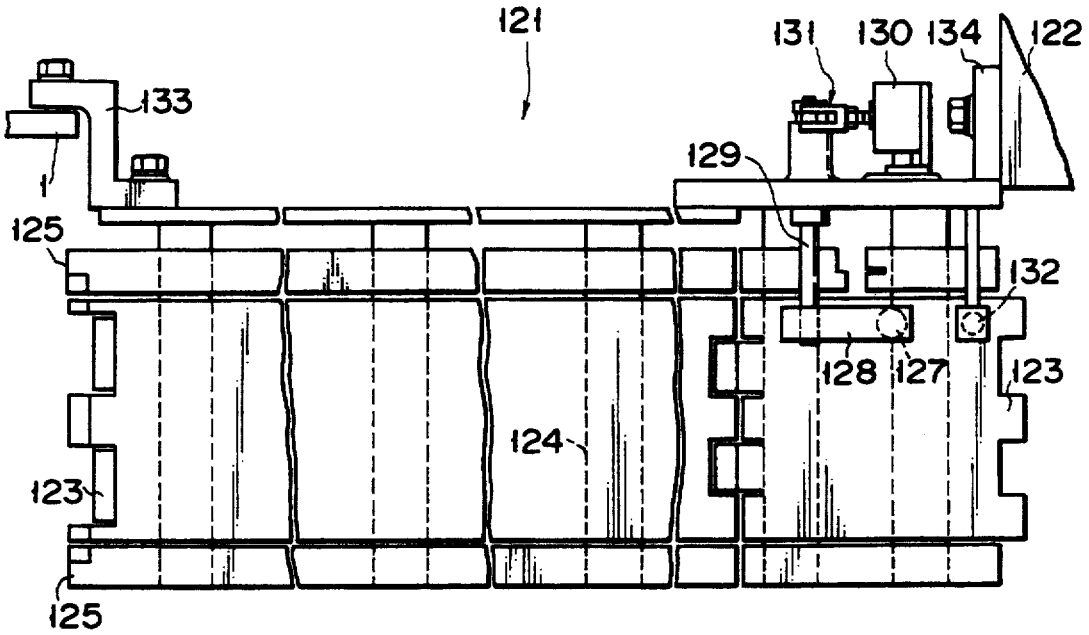
FIG. 17 is a plan view of a convey guide path.
Figure 18:
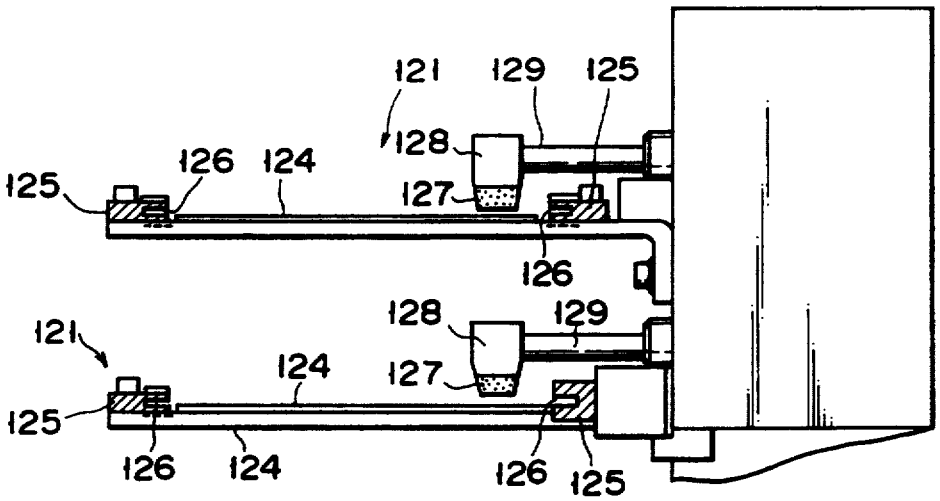
FIG. 18 is a sectional view of the convey guide path.

The convey restriction guide path 121 connects the above-mentioned loading station 1 and a joining station 122 arranged to be separated from the loading station 1, as shown in FIG. 1. The convey restriction guide path 121 is shown in detail in FIGS. 17 and 18. More specifically, the convey restriction guide path 121 has a bottom wall 124 constituted by arraying a large number of plate pieces 123. Side edge guides 125 are respectively arranged on two sides of the bottom wall 124. Opposing guide grooves 126 are formed in the side edge guides 125. The two side edges of the wrapping material A unrolled from the upstream side are guided by and conveyed along the guide grooves 126 of the corresponding side edge guides 125.

A stopper 127 is arranged near the terminal end of the convey regulation guide path 121 to be located immediately above the bottom wall 124. The stopper 127 is mounted on a rotating shaft 129 through an arm 128. The rotating shaft 129 is coupled to a piston rod of an air cylinder 130 through a link 131. Therefore, when the air cylinder 130 is expanded/contracted, the rotating shaft 129 is rotated in the forward/reverse direction. Thus, the stopper 127 can approach/separate from the bottom wall 124 of the convey restriction guide path 121 through the arm 128.

A sensor 132 similar to the sensor 89 described above is arranged immediately above the bottom wall 124 of the convey restriction guide path 121 on the downstream side of the stopper 127 in a convey direction. The sensor 132 is used not only to detect the register marks M of the wrapping material A but also to detect the trailing end of the wrapping material A (to be described later). Note that in FIG. 17, reference numerals 133 and 134 denote supports for supporting the convey restriction guide path 121 on the loading station 1 and the joining station 122.

Figure 19:
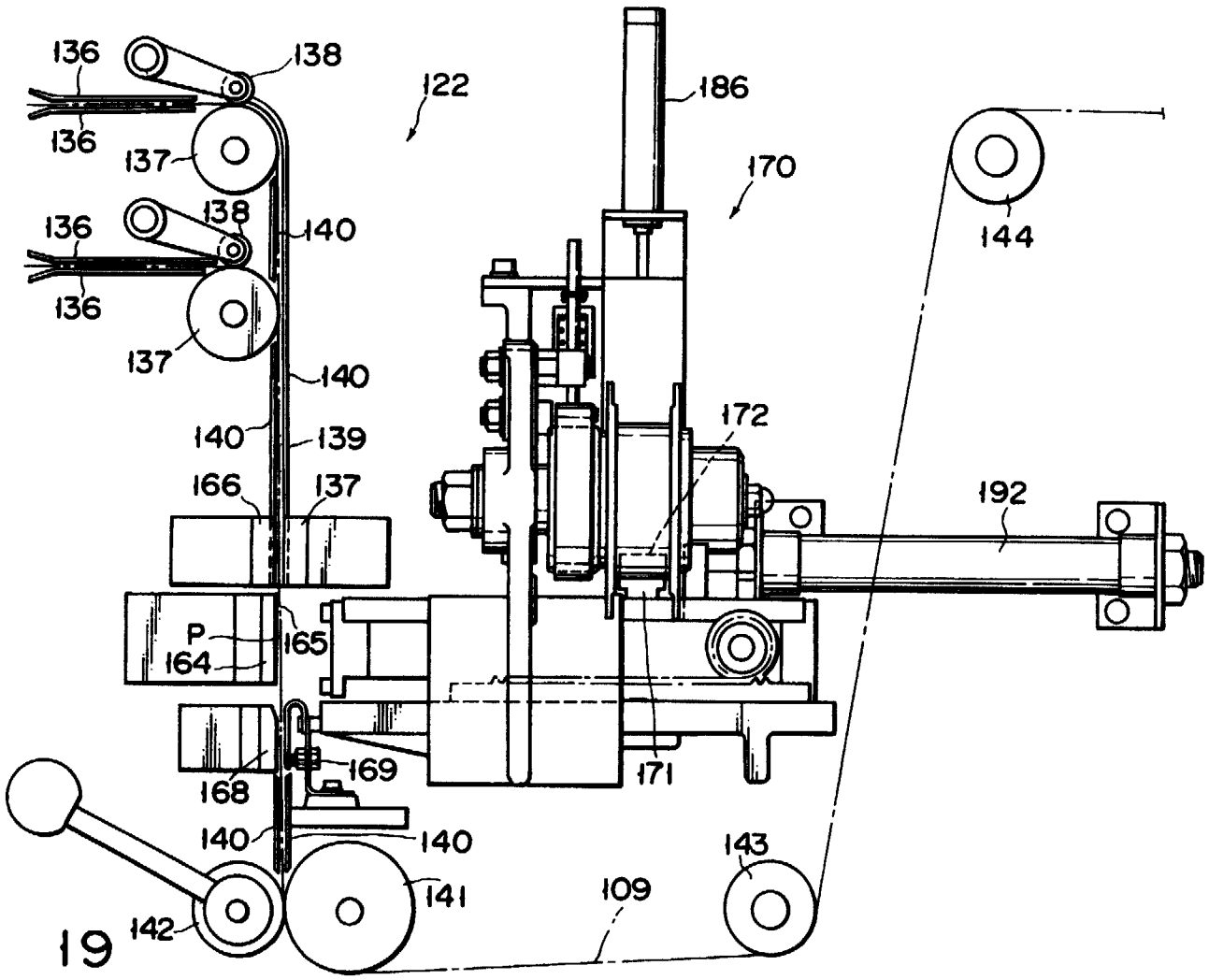
FIG. 19 is a side view of a joining means.

The convey restriction guide path 121 is connected to a pair of guide plates 136 for defining a portion of the convey path 109 of the wrapping material A in the joining station 122, as shown in FIG. 19. Base feed rollers 137 are arranged at the terminal ends of these guide plates 136. A pinch feed roller 138 is brought into rolling contact with each base feed roller 137 to approach/separate from it. The structures and drive systems of these base feed rollers 137 and the pinch feed rollers 138 are basically the same as those described above, and a detailed description thereof will be omitted. A joining preparation path 139 for guiding the wrapping material A in the vertical direction extends from the base feed rollers 137 and the pinch feed rollers 138. The joining preparation path 139 is also defined by a plurality of guide plates 140 in the same manner as described above.

Therefore, if the convey path 109 described so far is equipped, as described above, the leading end of the wrapping material A unrolled from the first roll R1 is formed at the cutting/unrolling unit 39, and the wrapping material A is then guided from the cutting/unrolling unit 39 to the convey restriction guide path 121. The wrapping material is then guided from the convey restriction guide path 121 to the convey path 109 on the downstream side of the joining preparation path 139 through the joining preparation path 139.

Since the unrolling operation of the wrapping material A from the second roll R21 is performed by the cutting/unrolling unit 39 and the convey path 109 having the same structures as those for the first roll R1, the cutting/unrolling unit 39 and the convey path 109 paired with the second roll R2 are schematically illustrated by imaginary lines in FIG. 8. However, as can be seen from FIGS. 18 and 19 in addition to FIG. 8, a portion, on the upstream side of the joining preparation path 139, of the convey path 109 extending from each cutting/unrolling unit 39 is independently arranged, and a portion on the downstream side of the joining preparation path 139 is a common path. In this embodiment, as can be seen FIGS. 18 and 19 and FIG. 8, the upper convey path 109 is paired with the first roll R1, and the lower convey path 109 is paired with the second roll R2. Thus, in the lower convey path 109, the same reference numerals denote portions having the same functions as in the upper convey path 109, and a detailed description thereof will be omitted.

As described above, the wrapping material A unrolled from the first roll R1 is further sent over the joining preparation path 139 of the convey path 109. In contrast to this, when the wrapping material A unrolled from the second roll R2 is conveyed to the joining preparation path 139 of the lower convey path 109 via the convey restriction guide path 121 after a new leading end is formed by the corresponding cutting/unrolling unit 39, the leading end is stopped at and held in a joining position P defined midway along the joining preparation path 139. More specifically, since the sensor 132 for detecting passage of the register marks M of the wrapping material A is arranged at the terminal end portion of each convey restriction guide path 121, the number of passing register marks M is counted by the sensor 132. When the count value reaches a predetermined value, the unrolling operation of the wrapping material A from the second roll R2 can be stopped, so that the leading end of the wrapping material A can be aligned at the joining position P. Thereafter, the stopper 127 of the lower convey restriction guide path 121 is moved downward, and the wrapping material A is clamped between the stopper 127 and the bottom wall 124 of the convey restriction guide path 121, so that the wrapping material A unrolled from the second roll R2 can be held in position while its leading end is aligned at the joining position P. Thus, joining preparation of the second roll R2 used after the first roll R1 is completed.

The unrolling operation of the wrapping material A from each cutting/unrolling unit 39 to the joining preparation path 139 is performed by the corresponding sets of the base feed rollers and the pinch feed rollers. The unrolling speeds of the sets of base and pinch feed rollers are increased toward the downstream side in the unrolling/convey direction of the wrapping material A. The sets of base and pinch feed rollers are opened/closed, that is, the pinch feed roller approaches/separates from the corresponding base feed roller at predetermined time intervals. Thus, the travel position of the wrapping material A can be easily corrected. When the leading end of the wrapping material A unrolled from each roll reaches the base and pinch feed rollers 137 and 138 on the side of the joining station 122, the sets of base and pinch feed rollers located on the upstream side are opened. Thus, zigzag travel of the wrapping material can be prevented, and the wrapping material A can be prevented from being wrinkled. During the unrolling operation of the wrapping material A from each roller R, a predetermined tension is applied to the wrapping material A by the tension roller 74 and the tension spring 77 of the cutting/unrolling unit 39 shown in FIG. 8, as a matter of course.

A base feed roller 141 and a pinch feed roller 142 which is in rolling contact with the base feed roller 141 to approach/separate from it are arranged at the terminal end, i.e., the lower end of the convey preparation path 139. These base and pinch feed rollers 141 and 142 have the same structures as those of the above-mentioned base and pinch feed rollers. However, these base and pinch feed rollers 141 and 142 can vary the unrolling speed of the wrapping material A. When the unrolling operation of the wrapping material A from the first roll R1 is taken over by the base and pinch feed rollers 141 and 142, the base and pinch feed rollers 137 and 138 are opened.

Figure 20:
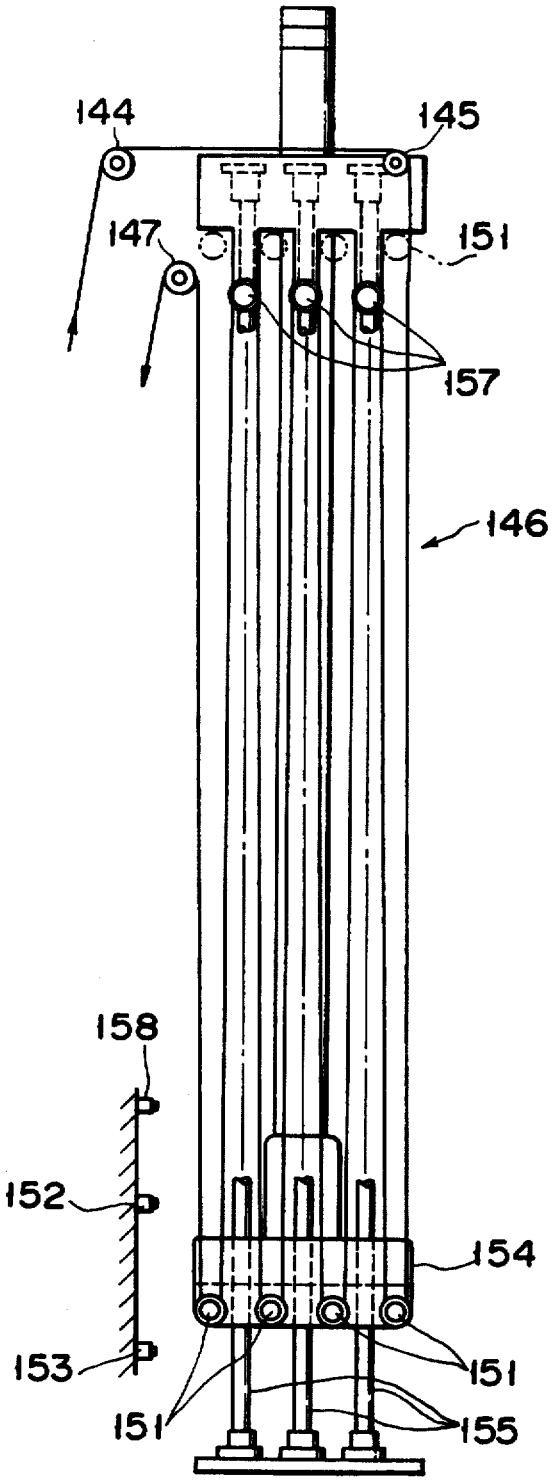
FIG. 20 is a front view of a dancer roller.

In the convey path 109 on the downstream side of the base and pinch feed rollers 141 and 142, the wrapping material A unrolled from the first roll R1 is guided to a dancer roller device 146 shown in FIG. 20 via guide rollers 143, 144, and 145. Thereafter, the wrapping material is guided from the dancer roller device 146 to a cutting device 150 shown in FIG. 22 via guide rollers 147, 148, and 149.

The dancer roller device 146 shown in FIG. 20 comprises four floating rollers 151 which are operated together in accordance with input and output amounts of the wrapping material A. With these floating rollers 151, the wrapping material A having a predetermined length can be accumulated. Upper and lower limit sensors 152 and 153 for respectively detecting upper and lower limit positions of the floating rollers 151 are fixed on the lower portion of the dancer roller device 146. More specifically, the unrolling speed of the base and pinch feed rollers 141 and 142 is controlled in accordance with the detection signals from these upper and lower limit sensors 152 and 153, so that four floating rollers 151 can be positioned between the upper and lower limit sensors 152 and 153.

A carrier 154 on which the four floating rollers 151 are rotatably arranged is movable upward/downward along three guide rods 155, and is moved upward/downward as needed by a rodless cylinder 156. In this case, in an upward movement range of the carrier 154 of this embodiment, the floating rollers 151 can be moved upward beyond three stationary rollers 157 located in the upper portion of the dancer roller device 146.

Figure 21:
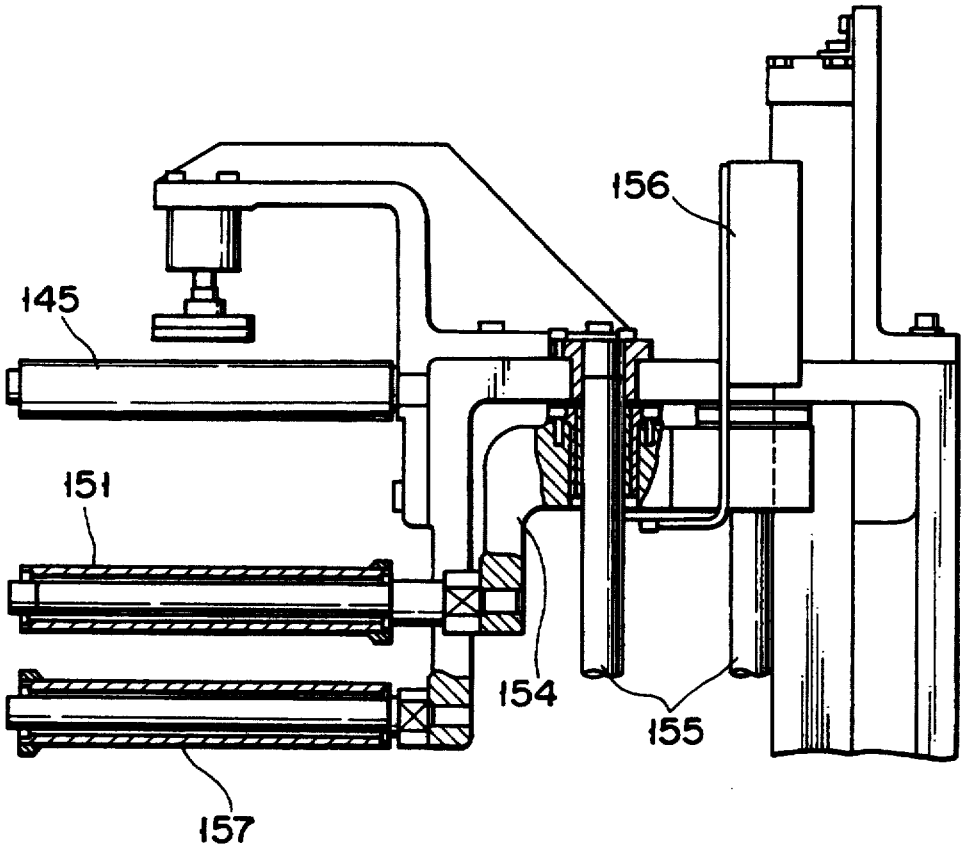
FIG. 21 is a sectional view of an upper portion of the dancer roller.

Therefore, since the floating rollers 151 can be located at upper positions beyond the stationary rollers 157, the wrapping material A unrolled from the first roll R1 can be easily wound around the stationary and floating rollers 157 and 151, or when the wrapping material A is cut, it can be easily rewound around these rollers. That is, as shown in FIG. 21, when the floating rollers 151 are located at the upper positions, the wrapping material A need only be inserted between a gap between these floating and stationary rollers 151 and 157 to be wound around these rollers.

Note that when the unrolling operation of the wrapping material A is stopped, the floating rollers 151 are moved upward to positions set by a sensor 158 (FIG. 20) by the rodless cylinder 156.

Figure 22:
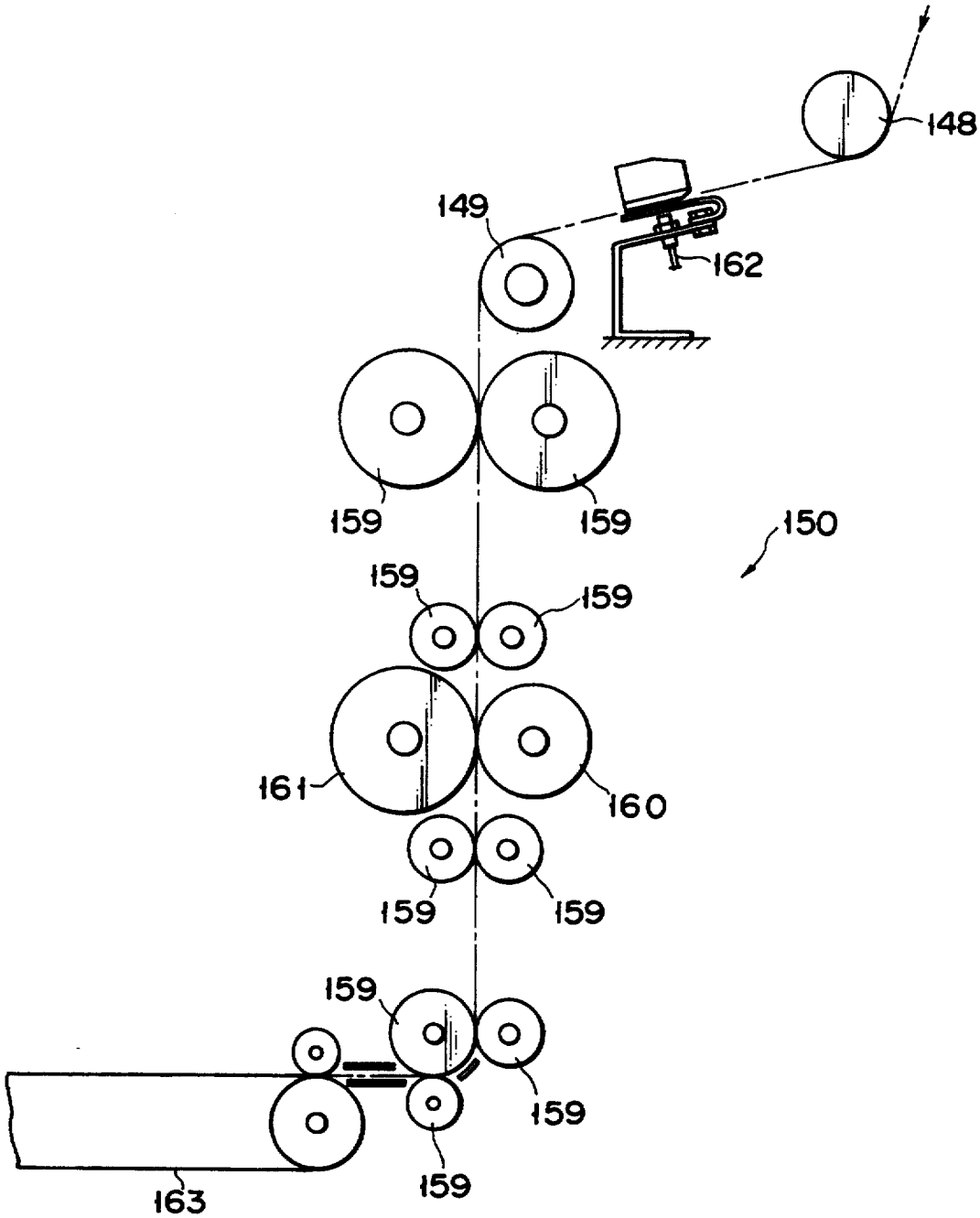
FIG. 22 is a schematic view of a cutting means.

The wrapping material A of the first roll R1 passing through the dancer roller device 146 is guided to the cutting device 150 shown in FIG. 22, as described above, and is sequentially cut at a predetermined position by the cutting device 150. In the cutting device 150, the convey path of the wrapping material A is defined by a plurality of pairs of feed rollers 159. In this convey path, a cutter roller 161 which is rotated to be in rolling contact with a reception roller 160 is arranged. A sensor 162 for detecting the register marks M of the wrapping material A is arranged between the guide rollers 148 and 149. Therefore, the rotations of the feed rollers 159 and the cutter roller 161 are controlled in accordance with the detection signal from this sensor 62, so that the wrapping material A can be cut at a predetermined position with reference to the register mark M. A wrapping material piece obtained by cutting in this manner has a length required for forming a soft package for a pack of cigarettes. The wrapping material pieces are sequentially fed to a wrapping machine (not shown) by utilizing, e.g., a conveyor 163, and the like.

Referring back to FIG. 19, the joining position P described above is determined at the central position of a reception surface 165 of a stamper receiver 164 arranged midway along the joining preparation path 139. A pair of suction brake units 166 and 167 are arranged above the stamper receiver 164 to sandwich the joining preparation path 139 therebetween. One suction brake unit 168 is arranged below the stamper receiver 164. These suction brake units are connected to negative pressure sources (not shown), and can hold the wrapping material passing the joining preparation path 139 by drawing it by suction. More specifically, when the leading end portion of the wrapping material A unrolled from the second roll R2 is aligned at the joining position P, the leading end portion is held by vacuum suction by the suction brake unit 166 and will not be accidentally moved.

A sensor 169 for detecting the register marks M of the wrapping material A is arranged below the suction brake unit 168. The sensor 169 is used to align the trailing end of the unrolled wrapping material A, in this case, the wrapping material A unrolled from the first roll R1 in cooperation with the sensor (FIG. 17) of the convey restriction guide path 121.

The trailing end of the first roll R1 is formed as follows. That is, when the wrapping material A of the first roll R1 runs short, and the photosensor 34 of the detection device 27 paired with the first roll R1 detects the end indication tape of the roll R1, the wrapping material A is cut by the cutter unit 90 of the cutting/unrolling unit 39 in the same manner as in its leading end. As a result, the trailing end of the wrapping material A is formed to leave a predetermined length from the last register mark M. Thereafter, when the trailing end of the wrapping material A passes by the sensor 132 of the convey restriction guide path 121, the trailing end of the wrapping material is detected by this sensor 132. Since the convey length of the wrapping material A between these sensors 132 and 169 is constant after the trailing end of the wrapping material A is detected by the sensor 132, if the number of register marks M of the wrapping material A is counted by the sensor 169 simultaneously with detection of the trailing end of the wrapping material A by the sensor 132, the last register mark M of the wrapping material A can be detected. When the sensor 169 detects the last register mark M of the wrapping material A, the convey operation of the wrapping material A is temporarily stopped. Thus, the trailing end of the wrapping material A from the first roll R1 is aligned at the joining position P to be continuous with the leading end of the wrapping material A from the second roll R2 without overlapping it. Alignment of the trailing end of the wrapping material A can be easily performed since the unrolling speed of the wrapping material can be varied by the base and pinch feed rollers 141 and 142. In this case, upon operation of the suction brake unit 168, the trailing end of the wrapping material of the first roll R1 is held by vacuum suction.

When the trailing end of the wrapping material A from the first roll R1 is aligned at the joining position P, a joining device 170 shown in FIG. 19 is operated. The joining device 170 joins the trailing end of the wrapping material A from the first roll R1 and the leading end of the wrapping material A from the second roll R2 by a joining tape.

Figure 23:
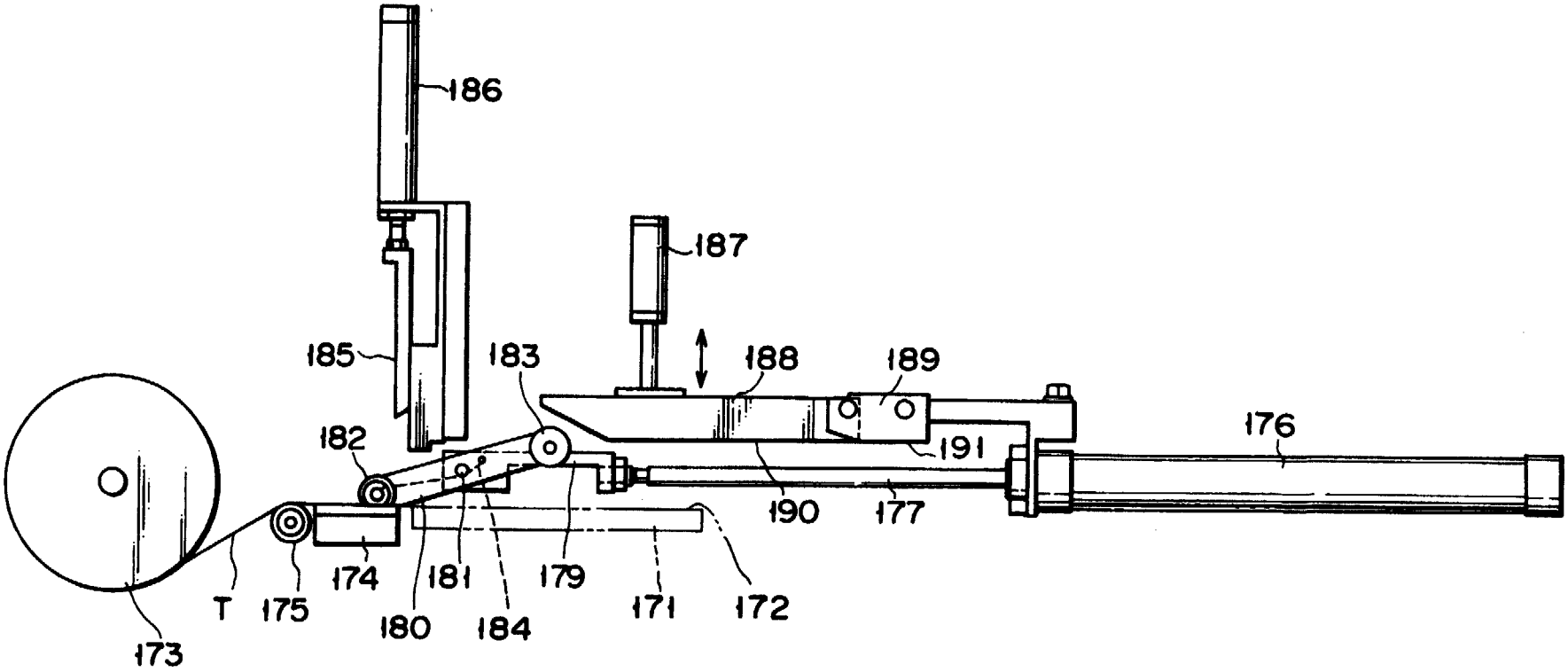
FIG. 23 is a partial schematic view of the joining means.

The joining device 170 will be described below. The joining device 170 comprises a joining stamper 171 for supplying the joining tape to the stamper receiver 168 although it is only schematically illustrated in FIG. 19. The joining stamper 171 has a suction surface 172 facing up at a rest position, and the joining tape is supplied to this suction surface 172. More specifically, the suction surface 172 extends in a direction perpendicular to the convey direction of the wrapping material A. A tape reel 173 winding an adhesive tape T thereon is rotatably arranged near the end portion of the suction surface 172, as schematically illustrated in FIG. 23. Rotation of the tape reel 173 is braked by a brake device (not shown). A suction base 174 connected to a negative pressure source (not shown) is arranged between the tape reel 173 and the joining stamper 171, and a guide roller 175 is arranged between the suction base 174 and the tape reel 173. The leading end portion of the adhesive tape T unrolled from the tape reel 173 via the guide roller 175 is held on the suction base 174 by vacuum suction. In this case, the adhesion surface of the adhesive tape T on the suction base 174 faces up.

Meanwhile, an unrolling cylinder 176 comprising an air cylinder is arranged near the Joining stamper 171 at a position opposite to the tape reel 173. A piston rod 177 of the unrolling cylinder 176 extends above the joining stamper 171. A support bracket 179 is mounted on the distal end of the piston rod 177. A central portion of a swing arm 180 is pivotally mounted on the support bracket 179 through a pin 181. An unrolling roller 182 with a ratchet is rotatably mounted on the distal end of the swing arm 180, and a guide roller 183 is rotatably mounted on the rear end thereof. The swing arm 180 is biased by a biasing spring 184 so that the unrolling roller 182 is located below the guide roller 183.

A cutter 185 is arranged above a position between the suction base 174 and the Joining stamper 171. The cutter 185 can be vertically moved by a lift cylinder 186. The cutter 185 has a function of cutting the adhesive tape T in cooperation with the suction base 174. Furthermore, a first guide 188 which is vertically movable by an air cylinder 187 is arranged above the joining stamper 171, and a second guide 189 is fixed nearer the air cylinder 176 than the first guide 188. The lower surfaces of these first and second guides 188 and 189 are formed as guide surfaces 190 and 191 which cooperate with the guide rollers 183, and these guide surfaces 190 and 191 partially overlap each other. As will be apparent from the following description, these guide surfaces 190 and 191 have a function of swinging the swing arm 180 to vertically move the unrolling roller 182.

FIGS. 24 to 31 show a sequence for supplying the adhesive tape T from the suction base 174 to the joining stamper 171 in turn.

Figure 24:
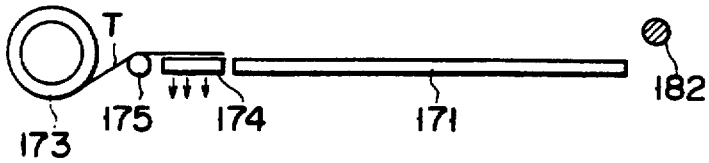
FIGS. 24 to 31 are schematic views showing some operations of the cutting means shown in FIG. 23.
Figure 25:
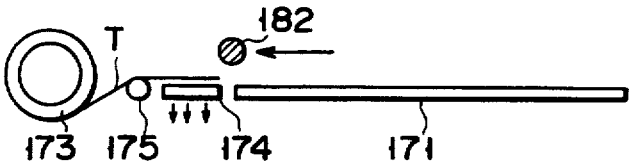
Figure 26:
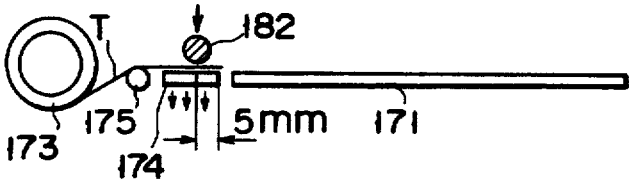
Figure 27:
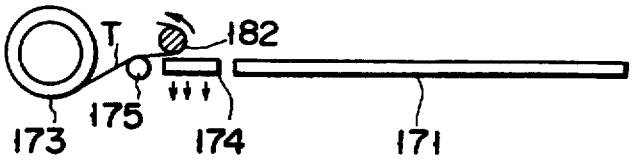

In a state shown in FIG. 24, the unrolling cylinder 176 is contracted, and, hence, the unrolling roller 182 is located above the end portion of the joining stamper 171 opposite to the suction base 174. In this case, since the first guide 188 is located at a lower position shown in FIG. 23, the guide surface 190 of the first guide 188 urges the guide roller 183 downward. In this state, when the unrolling cylinder 176 is expanded, the unrolling roller 182 moves to a position above the suction base 174 while maintaining its upward position, as shown in FIG. 25, and is moved downward at a position separated by, e.g., 5 mm from the end of the suction base 174, as shown in FIG. 26 to be placed on the adhesive tape T on the suction base 174. The downward movement of the unrolling roller 182 is attained in such a manner that the guide roller 183 of the swing arm 180 reaches the inclined portion of the guide surface 190 of the first guide 188. Thereafter, the first guide 188 is moved upward to a predetermined position.

Thereafter, the unrolling roller 182 is moved while being in rolling contact with the adhesive tape T on the suction base 174, and winds the adhesive tape T by a predetermined length.

Figure 28:
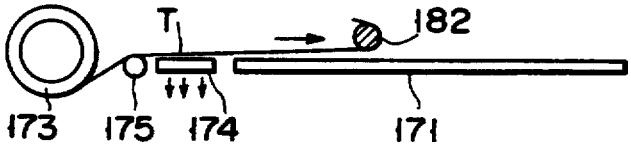
Figure 29:
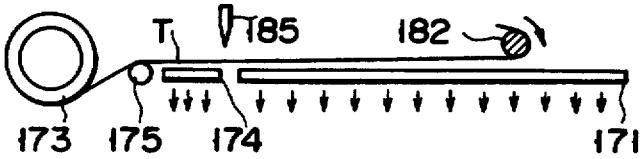

In this state, the unrolling roller 182 returns while unrolling the adhesive tape T on the joining stamper 171, as shown in FIG. 28. In this case, rotation of the unrolling roller 182 is stopped.

Figure 30:
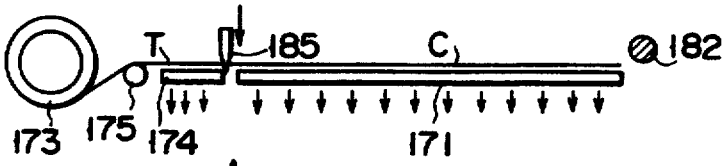
Figure 31:
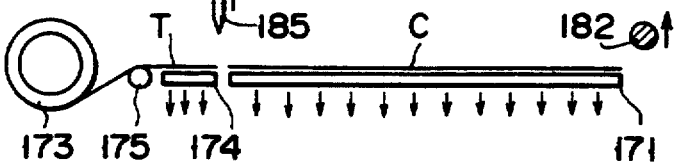

When the unrolling roller 182 is returned to a predetermined position above the joining stamper 171, the joining stamper 171 is connected to the negative pressure source to draw the adhesive tape T thereon by vacuum suction, and at the same time, the ratchet of the unrolling roller 182 is released. Thus, the unrolling roller 182 returns in a direction of an arrow in FIG. 29 while being in rolling contact with the joining stamper 171. Thus, a portion of the adhesive tape T wound around the unrolling roller 182 is released therefrom, and is drawn onto the joining stamper 171 by vacuum suction. In this state, the cutter 185 is moved downward to cut the adhesive tape T, as shown in FIG. 30. As a result, a joining tape C obtained by cutting the adhesive tape T is fed on the joining stamper 171. Thereafter, the cutter 185 is moved upward to a home position, while the unrolling roller 182 is moved upward since the guide roller 183 is actuated by the second guide 189.

Figure 32:
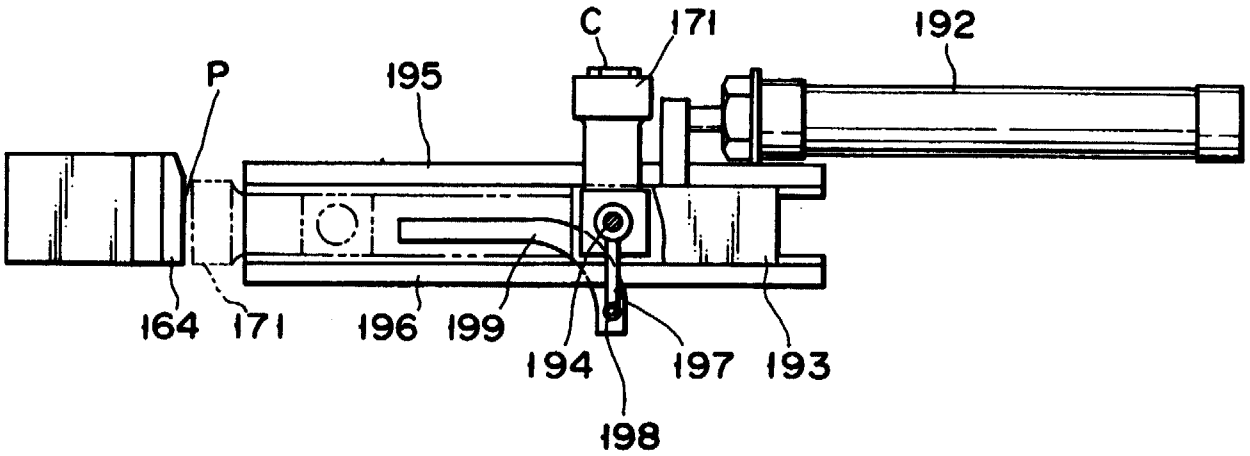
FIG. 32 is a schematic view showing another portion of the joining means.

When the joining tape C is fed onto the joining stamper 171, as described above, the joining stamper 171 is moved toward the stamper receiver 164 by a pushing cylinder 192 shown in FIGS. 19 and 32 while holding the joining tape C by vacuum suction. More specifically, the lower portion of the joining stamper 171 is mounted on a pivot shaft 194, and the two ends of the pivot shaft 194 are rotatably supported by a carrier 193. The carrier 193 is guided along a pair of upper and lower guide rails 195 and 196 to be movable toward the stamper receiver 164. In practice, the piston rod of the pushing cylinder 192 is coupled to the carrier 193.

Figure 33:
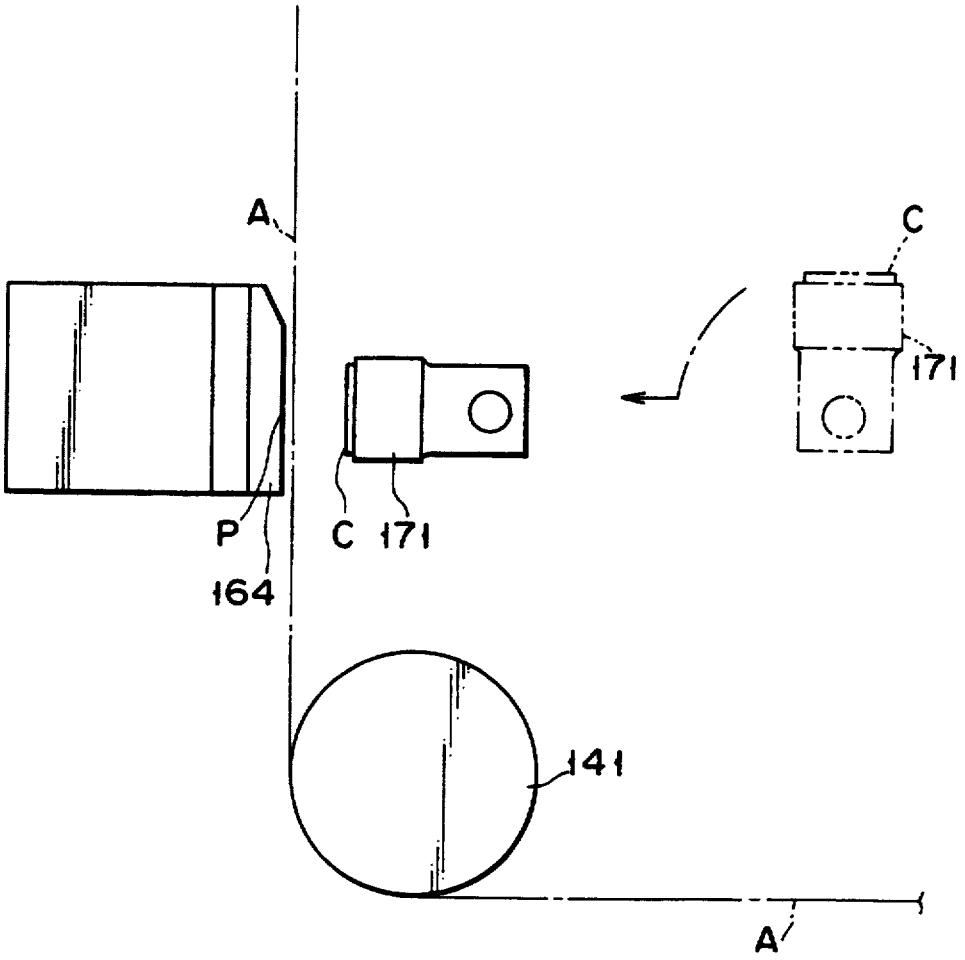
FIG. 33 is a schematic view for explaining an operation of the portion shown in FIG. 32.

As shown in FIG. 32, an arm 197 is arranged on the pivot shaft 194 of the joining stamper 171, and a cam follower 198 comprising a roller is mounted on the distal end of the arm 197. The cam follower 198 is engaged with a cam groove 199. The cam groove 199 is formed to pivot the joining stamper 171 through 90° so that the Joining tape C on the joining stamper 171 opposes the stamper receiver 164 when the carrier 193 is moved toward the stamper receiver 164. FIG. 33 schematically shows the movement of the joining stamper 171. As shown in FIG. 33, since the joining stamper 171 which receives and holds the joining tape C on its upper surface is rotated through 90° while it is moved toward the stamper receiver 164, the joining stamper 171 is brought into contact with the stamper receiver 164, so that the trailing end of the first wrapping roll R1 which stands by at the joining position P and the leading end of the wrapping material A of the second roll R2 can be joined by the joining tape C.

In this manner, after the wrapping materials A are joined, the wrapping material A is unrolled from the second roll R2.

When the wrapping material A is unrolled from the second roll R2, the first roll R1 is unloaded from the first loading shaft 2 after an already unrolled wrapping material is taken up. Thereafter, a new roll is loaded on the first loading shaft 2. After the leading end of the wrapping material A unrolled from this new roll is formed, the leading end is guided to and waits at the joining position P for the next joining operation.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. An apparatus for unrolling a strip-like member from a roll formed by winding a strip-like material and continuously supplying the unrolled strip-like material, in which at least a first and second roll can be loaded, wherein when unrolling of the strip-like material from one of said rolls is completed, a leading end of the strip-like material of the other roll, which is near a trailing end of said one roll, is joined to said trailing end so that the strip-like material can be supplied without interruption, and wherein indication tapes are adhered to leading and trailing end portions of the strip-like material of each of said rolls, said apparatus comprising:

first and second loading means for removably receiving said first and second rolls, respectively;

detection means for detecting indication tapes adhered to the strip-like materials of said rolls;

driving means for rotating each of the rolls received by said first and second loading means in first and second directions, said driving means rotating the other roll in the first direction opposite to the second direction in which the strip-like material is unrolled from the roll, and rotating the roll in said second direction when an indication tape adhered to the leading end portion of the strip-like material of the roll is detected by said detection means;

cutting/unrolling means including:

(a) a chuck head for contact with and movement away from circumferential surfaces of said rolls, said chuck head having a stationary chuck pawl and a movable chuck pawl for movement into contact with and movement away from said stationary chuck pawl, wherein when each of said rolls is rotated by said driving means in said second direction, said stationary chuck pawl peels the leading end portion of the strip-like material of the roll from the circumferential surface thereof, and the leading end portion as peeled is interposed between said stationary chuck pawl and said movable chuck pawl so as to draw said leading end portion;

(b) detecting means for detecting that said stationary chuck pawl has peeled the leading end portion of the strip-like material of the roll from the circumferential surface of the roll, said detecting means closing the chuck head after detection such that the leading end portion of the strip-like material of the roll is interposed between the stationary chuck pawl and movable chuck pawl;

(c) cutting means for cutting an unnecessary part of the leading end portion of the strip-like material which is drawn by said chuck head, and cutting the trailing end portion of the strip-like material when said detection means detects an indication tape adhered to said trailing end portion, said detection means detects the indication tape after the leading end of the strip-like material of the other roll rotated in a first direction by said driving means passes under said chuck head, whereby the rotation of the other roll is stopped by said driving means, the other roll is reversely rotated in a second direction, and the leading end of the strip-like material of the other roll passed under said chuck head approaches said chuck head in the second direction and is pulled away from the circumferential surface of the other roll by said chuck pawls of said chuck head; and guide means, comprising a joining station arranged in a middle portion thereof, for guiding the strip-like material fed from said cutting/unrolling means along a predetermined path;

feed means for conveying the strip-like material unrolled from one of said first and second rolls along said guide means via said joining station, for feeding the strip-like material unrolled from the other roll to said joining station, and for causing the leading end of the other strip-like material to stop and stand by at a position of said joining station;

dancer roller means arranged midway along said guide means and on a downstream side of said joining station in a convey direction of the strip-like material, for accumulating a portion of the strip-like material conveyed along said guide means; and joining means arranged near said joining station, for, when the trailing end of the one strip-like material passes through said joining station, joining the leading end of the other standby strip-like material to the trailing end of the one strip-like material by a joining tape.

2. An apparatus according to claim 1, wherein said first and second loading means respectively comprise first and loading shafts, each of said first and second loading shafts being coupled to electric motors and power brakes, said electric motors rotating said first and second loading shafts, and said powder brakes providing a rotational resistance to said first and second loading shafts, so that when the strip-like material is unrolled from the roll loaded on one of said first and second loading shafts, a predetermined tension is given to the unrolled strip-like material.

3. An apparatus according to claim 1, wherein said first and second loading means respectively comprise first and second loading shafts, locking lugs being arranged on each of said first and second loading shafts, and said locking lugs projecting from the peripheral surfaces of said first and second loading shafts to hold the rolls unloaded thereon.

4. An apparatus according to claim 1, wherein said and second loading means respectively comprise first and second loading shafts, and each of said first add second loading means comprises a release pusher for, when the strip-like material unrolled from the roll loaded on a corresponding one of said first and second loading shafts is used up, pushing and detaching the roll from the corresponding one of said first and second loading shafts.

5. An apparatus according to claim 1, wherein said detecting means is a photosensor provided to the stationary chuck pawl and movable chuck pawl for optically detecting insertion of the leading end portion of the strip-like material between the pawls.

* * * * *